US008237526B2

(12) United States Patent
Putman et al.

(10) Patent No.: US 8,237,526 B2
(45) Date of Patent: Aug. 7, 2012

(54) NONDESTRUCTIVE CAPTURE OF PROJECTILES

(75) Inventors: Philip Travis Putman, Huron, OH (US); Kamel Salama, Houston, TX (US)

(73) Assignee: Sierra Lobo, Inc., Fremont, OH (US)

( * ) Notice: Subject to any disclaimer, the term of this patent is extended or adjusted under 35 U.S.C. 154(b) by 517 days.

(21) Appl. No.: 12/481,147

(22) Filed: Jun. 9, 2009

(65) Prior Publication Data

US 2009/0302982 A1 Dec. 10, 2009

Related U.S. Application Data

(60) Provisional application No. 61/059,883, filed on Jun. 9, 2008.

(51) Int. Cl.
*H01F 7/00* (2006.01)
*H01F 1/00* (2006.01)
*F41B 6/00* (2006.01)

(52) U.S. Cl. ..... 335/219; 335/266; 335/282; 335/268; 335/274; 335/279; 335/299; 124/3; 310/12.07

(58) Field of Classification Search ..... 124/3; 335/266, 335/282, 238, 279, 219, 220, 239, 250, 256, 335/261, 268, 274, 299; 89/8, 28.05, 14.3, 89/42.03, 42.01; 310/12.07, 12.15, 12.22, 310/12.24, 14
See application file for complete search history.

(56) References Cited

U.S. PATENT DOCUMENTS 811,913 A * 2/1906 Foster, Jr. ..... 124/3
1,241,333 A * 9/1917 Bowman ..... 124/3
3,196,797 A * 7/1965 Marini ..... 417/418
3,205,425 A * 9/1965 Moyer ..... 363/90
3,883,633 A * 5/1975 Kohler ..... 310/152
4,274,136 A * 6/1981 Onodera et al. ..... 363/68
4,319,168 A * 3/1982 Kemeny ..... 318/135
4,347,463 A * 8/1982 Kemeny et al. ..... 318/135
4,432,333 A * 2/1984 Kurherr ..... 124/3
4,540,905 A * 9/1985 Morino et al. ..... 310/12.01
4,714,003 A * 12/1987 Kemeny ..... 89/8
4,754,687 A * 7/1988 Kemeny ..... 89/8
(Continued)

OTHER PUBLICATIONS

Bennett, J. et al., "Electromagnetic braking of a metallic projectile in flight," IEEE Transactions on Magnetics, vol. Mag-21, No. 3, May 1985, pp. 1250-1253.

(Continued)

*Primary Examiner* — Mohamad Musleh
(74) *Attorney, Agent, or Firm* — Pearne & Gordon LLP

(57) ABSTRACT

Apparatus for inductive braking of a projectile are disclosed. Embodiments include a receiver that has a unidirectional conductor having a closed conductive pathway that encircles a passageway for a moving projectile. The unidirectional conductor permits current to flow through it in substantially only one direction around the passageway. As the projectile and its associated magnetic field move past the unidirectional conductor, the moving magnetic field induces a current flow through the closed conductive pathway, which in turn generates a magnetic field behind the projectile having the same polarity as the projectile's field. The two fields attract one another, which both exerts a braking force on the projectile and tends to align the two fields. Alignment of these fields centers the projectile away from the passageway wall. Because the unidirectional conductor permits current to flow in substantially only the direction that produces a field having the same polarity as the moving field, the opposite-polarity repulsive magnetic field that would otherwise be generated ahead of the projectile, which would otherwise deflect the projectile from its path, is suppressed. Methods of inductive braking are also disclosed.

32 Claims, 18 Drawing Sheets

U.S. PATENT DOCUMENTS

| | | | | |
|---|---|---|---|---|
| 4,913,030 | A * | 4/1990 | Reynolds | 89/8 |
| 5,017,549 | A * | 5/1991 | Robertson | 505/164 |
| 5,168,118 | A * | 12/1992 | Schroeder | 89/8 |
| 5,173,568 | A * | 12/1992 | Parmer | 89/8 |
| 5,217,948 | A * | 6/1993 | Leung et al. | 124/3 |
| 5,431,083 | A * | 7/1995 | Vassioukevitch | 89/8 |
| 6,208,742 | B1 * | 3/2001 | Garcia et al. | 381/401 |
| 6,211,766 | B1 * | 4/2001 | Goseberg et al. | 336/198 |
| 7,043,925 | B2 | 5/2006 | Haberbusch | |
| 7,077,046 | B2 * | 7/2006 | Nelyubin | 89/8 |
| 7,111,619 | B2 * | 9/2006 | Schneider | 124/8 |
| 7,347,053 | B1 | 3/2008 | Haberbusch et al. | |
| 7,378,765 | B2 * | 5/2008 | Iwasa et al. | 310/14 |
| 7,434,407 | B2 | 10/2008 | Haberbusch et al. | |
| 7,459,807 | B2 * | 12/2008 | Putman et al. | 310/12.07 |
| 2005/0280316 | A1 * | 12/2005 | Nozawa et al. | 310/12 |
| 2005/0285452 | A1 | 12/2005 | Putman et al. | |
| 2008/0150374 | A1 * | 6/2008 | Chang et al. | 310/12 |

OTHER PUBLICATIONS

Cardwell, D.A. et al., "Round robin measurements of the flux trapping properties of melt processed Sm-Ba-Cu-O bulk superconductors," Physica C, 412-242, 2004, pp. 623-632.

Conway, John T., "Inductance calculations for noncoaxial coils using Bessel functions," IEEE Transactions on Magnetics, vol. 43, No. 3, Mar. 2007, pp. 1023-1034.

Gruss, S. et al., "Superconducting bulk magnets: Very high trapped fields and cracking," Applied Physics Letters, vol. 79, No. 19, Nov. 5, 2001, pp. 3131-3133.

Halliday, D. et al., "Fundamentals of Physics," Wiley and Sons, 1988, p. 746.

Levin, G.A. et al., "Persistent current in coils made out of second generation high temperature superconductor wire," Applied Physics Letters, vol. 93, 2008, pp. 062504-1-0624504-3.

Mongeau, Peter Parr, "Coaxial air core electromagnetic accelerators," M.I.T. Ph.D Dissertation, 1982, pp. 1-311.

Murakami, Masato, "Measurements of trapped-flux density for bulk high-temperature superconductors," Physica C 357-360, 2001, pp. 751-754.

Partovi, M.H. et al., "Electrodynamics of a magnet moving through a conducting pipe," Canadian Journal of Physics, vol. 84, 2006, pp. 253-271.

Persad, Chadee, "A review of U.S. patents in electromagnetic launch technology," IEEE Transactions on Magnetics, vol. 37, No. 1, Jan. 2001, pp. 493-497.

Putman, P.T. et al., "Capture dynamics of coaxial magnetic brakes," IEEE Transactions on Magnetics, vol. 45, No. 1, Jan. 2009, pp. 417-422.

www.superconductors.org/Type2.htm, "Type 2 Superconductors".

Tomita, M. et al., "High-temperature superconductor bulk magnets that can trap magnetic fields of over 17 tesla at 29 K," Nature, vol. 421, Jan. 30, 2003, pp. 517-520.

Wilson, Martin H., "Superconducting Magnets," Oxford University Press, 1990, p. 41.

* cited by examiner

NONDESTRUCTIVE CAPTURE OF PROJECTILES

This application claims the benefit of U.S. Provisional Application Ser. No. 61/059,883 filed Jun. 9, 2008, the contents of which are incorporated herein by reference.

BACKGROUND OF INVENTION

1. Field of the Invention

The invention relates to the conversion of kinetic energy of a projectile into thermal energy to slow the projectile via inductive braking. More particularly it relates to an improved inductive-braking apparatus for nondestructive capture of hypervelocity projectiles.

2. Description of Related Art

Inductive braking (also referred to as magnetic braking) relies on the generation of induced magnetic fields to supply braking force to a moving projectile, which has its own magnetic field. The moving field source, associated with the projectile, can be a permanent or electro-magnet secured to a projectile it is desired to stop, moves along a path adjacent a conductor, for example through the hollow bore of a cylindrical sleeve or other long enclosure made of metal or other conductive material. As the field source moves along the conductor length, it induces a flow of currents through the conductor, which in turn generates induced magnetic fields. Typically, two such fields are induced: one behind the projectile having the same polarity as the projectile's field, and one ahead of the projectile having opposite polarity. The induced magnetic field ahead of the projectile repels the field associated with the projectile. The induced field behind the projectile attracts the projectile's field. The effect of these magnetic interactions is to magnetically decelerate the projectile along its path adjacent the conductor, converting its kinetic energy into thermal energy that is absorbed in and can be dissipated from both the projectile and the adjacent conductor.

Inductive braking has been used in some applications. Its use is limited by the field strength of the magnetic-field source in the projectile, because this limits the available braking force. As will be appreciated, the amount of braking force required will depend on the mass of the projectile, its initial velocity and the required stopping distance. The fields produced by permanent magnets may be sufficient for conventional applications, with projectile masses and speeds limited only by the required stopping distance and limitations on brake system mass. However, at the speeds and masses of interest in hypervelocity applications (for example launching payloads from Earth to be retrieved by a receiver in orbit), the fields produced by conventional permanent magnets will not stop projectiles in a practical distance. The field produced by the best permanent magnets is approximately 0.5 Tesla. This will be insufficient to arrest a hypervelocity projectile of even modest mass, or other high-energy projectile, within a reasonable distance.

Increased braking force is desirable to achieve adequate braking of a hypervelocity or other high-energy projectile within a reasonable distance. In addition, it is desirable to ensure that the hypervelocity projectile will not be damaged during deceleration, particularly in hypervelocity applications, for example by impacting the conductor that is used to generate the induced magnetic field.

SUMMARY OF THE INVENTION

An inductive braking system is disclosed. The system has a unidirectional conductor having a closed conductive pathway that permits current to flow in substantially only one direction, and a passageway for receiving a projectile. The passageway has a longitudinal axis, and the unidirectional conductor is arranged such that the closed conductive pathway encircles the longitudinal axis.

A method of decelerating a projectile is also disclosed, which includes the following steps: a) generating a first magnetic field that moves with the projectile; b) directing the projectile along a path that is encircled by a closed conductive pathway; and c) inhibiting induction of a current through the conductive pathway in a direction that would generate a magnetic field of opposite polarity to the first magnetic field. As the projectile travels past the closed conductive pathway along the path, the first magnetic field produces a changing magnetic flux in a vicinity of the closed conductive pathway that induces a current in the closed conductive pathway in a direction that produces a second magnetic field having the same polarity as the first magnetic field.

A further inductive braking system includes a catch tube with a passageway for receiving a projectile, and a unidirectional conductor having a closed conductive pathway that encircles the passageway. The closed conductive pathway permits current to flow in substantially only one direction around the passageway. A projectile travels through the passageway, with a first magnetic field moving with the projectile. The first magnetic field produces a changing magnetic flux in a vicinity of the closed conductive pathway, which induces a current to flow through the closed conductive pathway in the aforementioned one direction around the passageway. The induced current generates a second magnetic field at a location behind the projectile. The second magnetic field has the same polarity as the first magnetic field such that an attraction between them exerts a braking force on the projectile and also tends to align the first magnetic field, which is moving with the projectile, on a common central axis with the second magnetic field.

BRIEF DESCRIPTION OF THE DRAWINGS

FIG. 17*a* illustrates voltage versus time during a glide phase of the projectile.

FIG. 23*a* shows braking force versus filament separation. FIG. 23*b* shows centering force versus gap between the filaments.

DETAILED DESCRIPTION OF PREFERRED EMBODIMENTS

Figure 1:
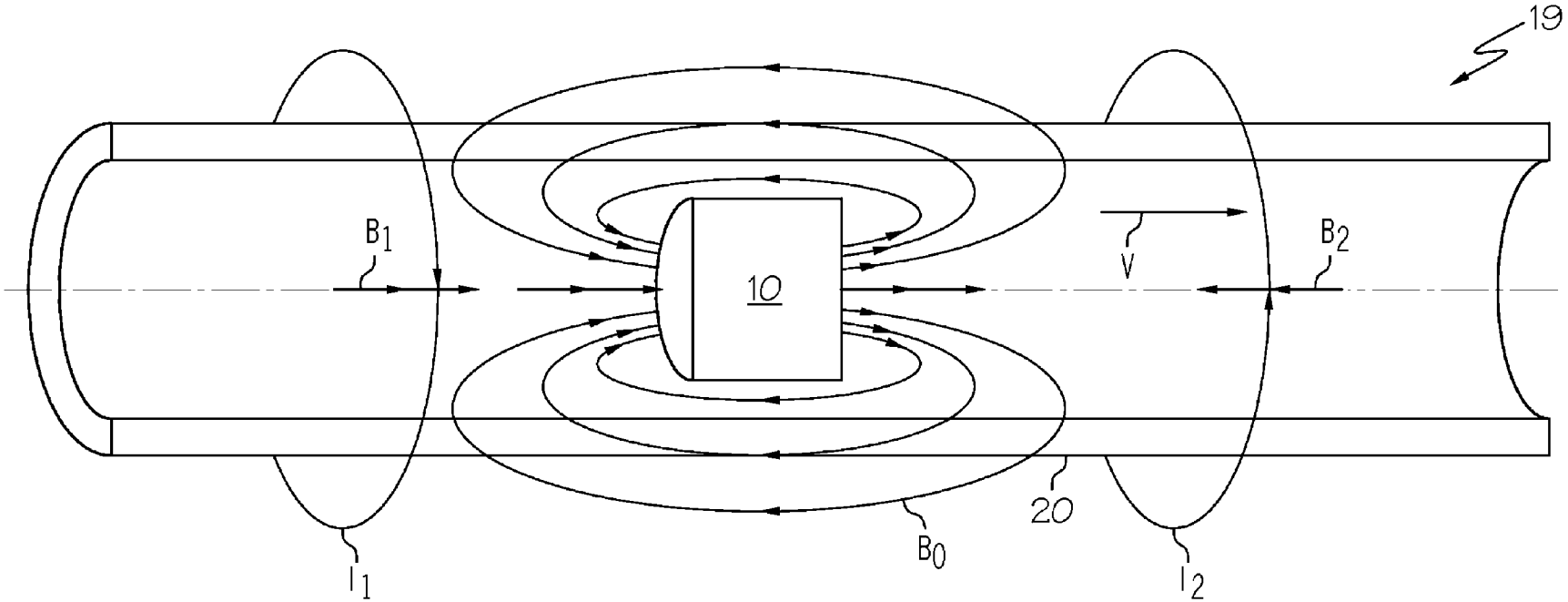
FIG. 1 is a side schematic view of an induction-braking system including a conductive tube 20 and a projectile 10 that is or includes a magnetic field source traveling through the tube, to decelerate the projectile via inductive braking.

A typical coaxial inductive brake design is illustrated in FIG. 1. As seen in the figure, a projectile 10 (field source) travels in a direction V through deceleration passageway 26 of a receiver 19, which in FIG. 1 is a conductive tube 20. The conductive tube is generally made of an extruded or rolled metal form, such as aluminum, steel or iron. The projectile 10 has an associated magnetic field $B_0$. The field $B_0$ is a permanent magnetic field that is characteristic of the projectile 10, or of a permanent magnet or an energized electromagnet that is secured to and moving with the projectile 10. As will be understood by persons of ordinary skill in the art in conformance with Faraday's Law, the motion of the projectile 10 and its associated magnetic field $B_0$ through the conductive tube 20 induces currents in that tube both ahead of and trailing the projectile 10. The induced current $I_1$ in the tube 20 trailing the projectile 10 produces an induced magnetic field $B_1$ having the same polarity as the magnetic field $B_0$ of the projectile. As a result, the fields $B_1$ and $B_0$ produce an attractive force that acts opposite the velocity direction of the projectile 10, V, which tends to decelerate the projectile 10. At the same time, the induced current $I_2$ in the conductive tube 20 ahead of the projectile 10 produces an induced magnetic field $B_2$ having opposite polarity compared to the field $B_0$ of the projectile. As a result, the fields $B_2$ and $B_0$ produce a repulsive force that also acts opposite the velocity direction of the projectile 10, V. Thus, like the attractive force resulting from $B_1$ trailing the projectile 10, the repulsive force resulting from $B_2$ ahead of the projectile 10 also tends to decelerate it.

In addition to decelerating the projectile 10, it is desirable to ensure that the projectile 10 does not impact the wall of the receiver 19, which can damage or destroy both the projectile and the receiver 19 (e.g. conductive tube 20), particularly at hypervelocity speeds. It turns out that the attractive force attributable to the trailing magnetic field $B_1$ exerts a centering effect on the projectile 10 that continually restores it to a central radial position within the passageway 26, and out of contact with the receiver 19 (tube 20). Conversely, the magnetic field $B_2$ ahead of the projectile 10, though it decelerates the projectile 10, it also tends to deflect that projectile laterally into the wall of the receiver 19. These effects are explained in greater detail below in connection with arbitrary field-source bodies 200 and 300 illustrated in FIGS. 2-8.

In the "a" figures of FIGS. 2-8, arbitrary field-source bodies 200 and 300 are illustrated having a variety of spatial arrangements relative to one another. The "b" figures of FIGS. 2-8 illustrate the magnetic-field lines of the bodies 200 and 300 spatially arranged as in the corresponding "a" figure, taken along a central y-z cross-section. The magnitudes of the qualitatively-illustrated fields are in arbitrary units, with the caveat that each of the bodies 200 and 300 has the same strength (magnitude) magnetic field throughout all of the spatial orientations illustrated in FIGS. 2-8. The respective magnetic fields of the bodies 200 and 300 are attractive in FIGS. 2-5 and repulsive in FIGS. 6-8. The smaller body 200 in FIGS. 2-8 can be analogized to the projectile 10 illustrated in FIG. 1, and the larger body 300 can be analogized to the conductive tube 20. Under this analogy, the body 200 can be assumed to be moving (have a velocity vector) in the negative z direction in the "a" figures.

Now referring specifically to FIGS. 2-8, it is noted that in order to prevent contact between a projectile 10 (analogize body 200) and a receiver (e.g. conductive tube 20—analogize body 300), the projectile should experience restoring (centering) forces both when it is displaced from a central axial position relative to the tube (body 300), and when it is rotated relative to one of the spatial axes (x- or y-axes) normal to their common central axis (z-axis). The case in which the fields of bodies 200 and 300 are attractive is discussed first with reference to FIGS. 2-5.

Figure 2A:
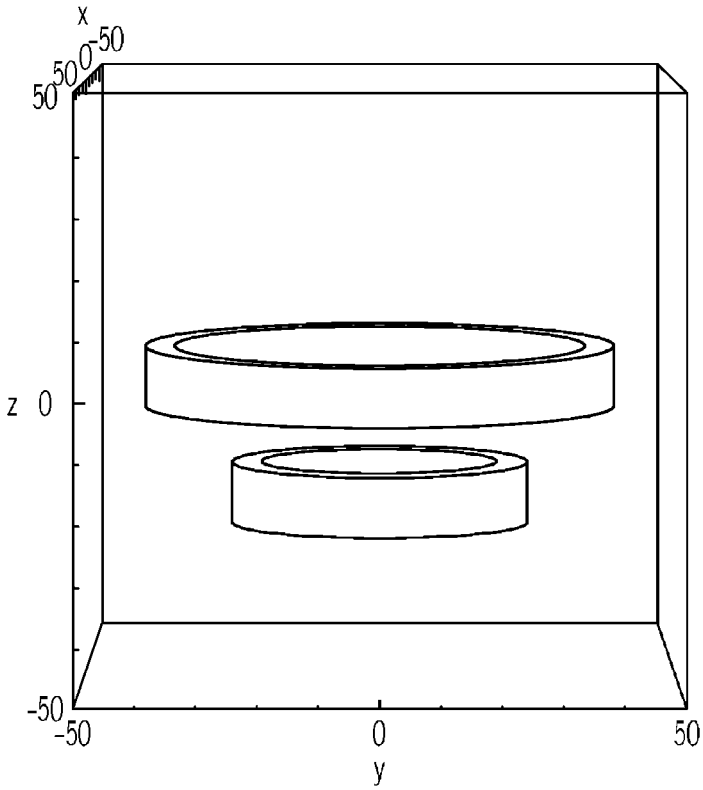
FIGS. 2*a*-2*b* illustrate arbitrary field source bodies 200 and 300 having attractive magnetic fields, which are aligned coaxially and spaced an axial distance from one another. Their relative positions are shown in FIG. 2*a* and the corresponding magnetic field lines taken along a central y-z cross-section are shown in FIG. 2*b*.
Figure 2B:
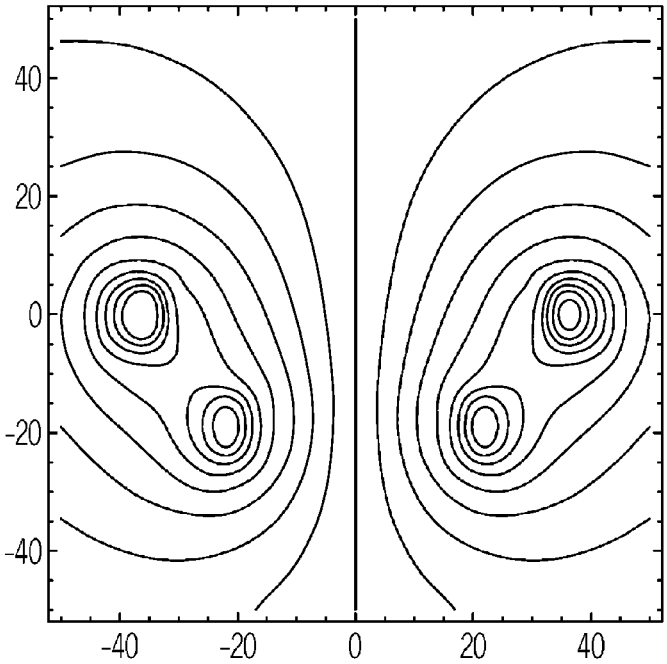

FIG. 2*a* illustrates the case where the bodies 200 and 300 are aligned concentrically along their common central (z) axis. The smaller body 200 is not rotating in the case illustrated in FIG. 2*a*. The corresponding field diagram, FIG. 2*b*, illustrates the field lines for their respective magnetic fields taken in a y-z plane that includes their central axis. The force and torque directions for the body 200 can be observed qualitatively from the plot of the field lines in FIG. 2*b*. Field lines can be thought of as acting "somewhat like stretched rubber bands." (David Halliday and Robert Resnick, *Fundamentals of Physics*, Wiley and Sons, NY, 1988, p. 746). In the flux line plot, the lines that encircle both the bodies 200 and 300 act to push together. Because the field lines are symmetric about the common central (z) axis of the bodies 200 and 300, there is no net force vector in either the x or y directions acting between the bodies, nor is there any torque on the projectile. The calculated {x,y,z} force vectors on the body 200 in the arbitrary force units illustrated in FIGS. 1*a-b* are {0,0,19} using Mathematica and Radia numerical solution software packages. The corresponding torque vectors in the arbitrary force-distance units are {0,0,0}. As can be seen, when the two bodies 200 and 300 having attractive magnetic fields are aligned concentrically without rotation, no force acts to displace the bodies laterally toward one another (i.e. no forces in the x or y directions).

Figure 3A:
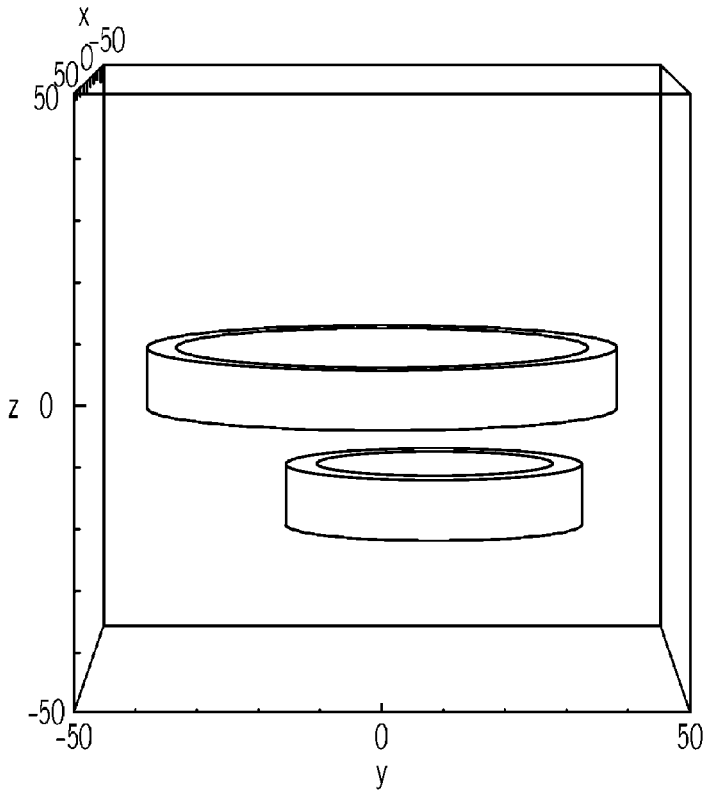
FIGS. 3*a*-3*b* illustrate the same arbitrary field source bodies 200 and 300 as in FIGS. 2*a*-2*b* and their corresponding magnetic field lines along a central y-z cross-section, but for the case where the body 200 is displaced radially to the right of center.
Figure 3B:
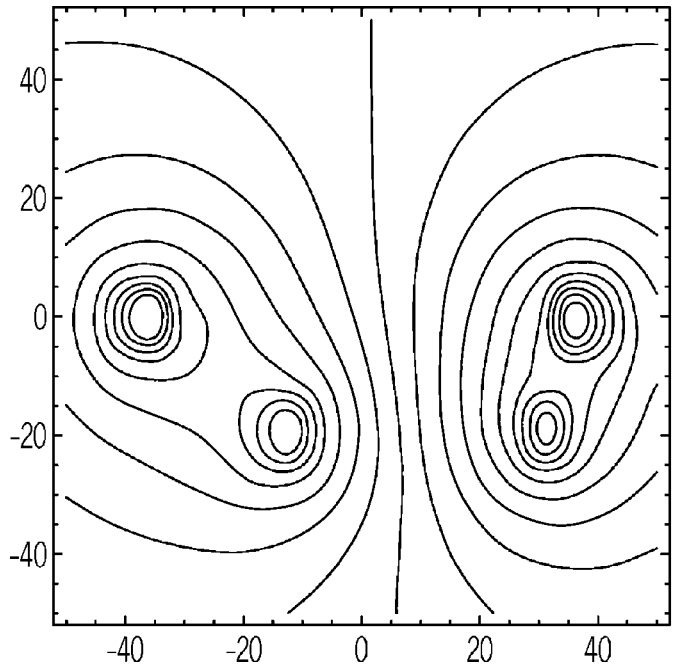
Figure 4A:
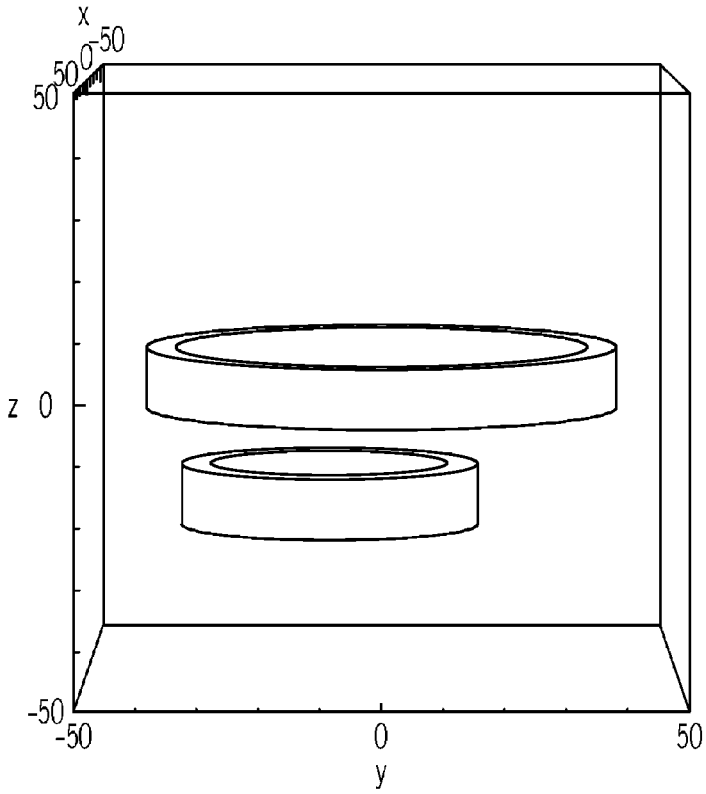
FIGS. 4*a*-4*b* are similar to FIGS. 3*a*-3*b*, except with the body 200 being displaced radially to the left of center.
Figure 4B:
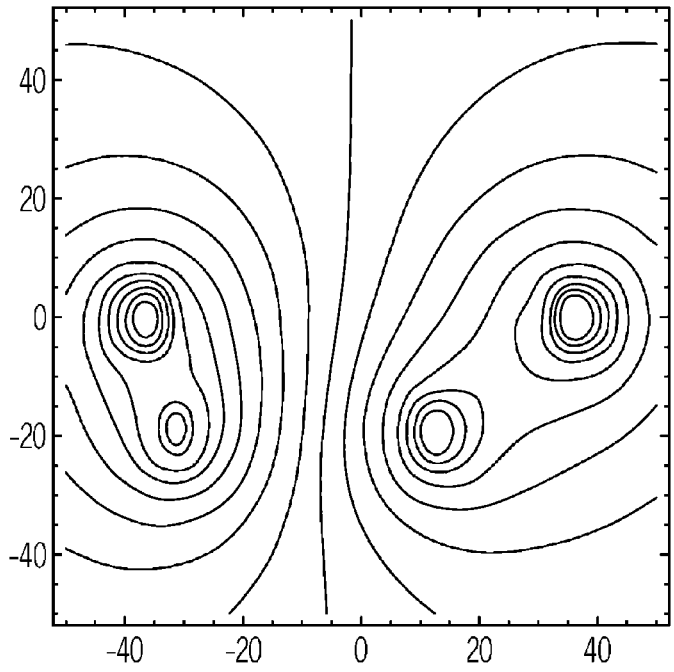

FIGS. 3*a* and 4*a* illustrate cases wherein the smaller body 200 is displaced off-center of the central z-axis for the body 300, in opposite directions (to the right y-direction in FIG. 3*a* and the left y-direction in FIG. 4*a*). Again, no rotation is present. As can be observed qualitatively and calculated in the arbitrary units from the corresponding field-line diagrams, FIGS. 3*b* and 4*b*, when the body 200 is off center relative to the larger body 300 but otherwise similarly spaced in the z-direction as in FIG. 1, assuming the same field strengths, the z-component of their attractive force (in the axial direction) is essentially unchanged from FIG. 1. For example, in the arbitrary force units of the figures, the net force vectors for FIG. 3*b* are {0,−3,19}, and for FIG. 4*b* they are {0,3,19}. Hence, in the case of FIGS. 3*a-b*, wherein the body 200 is displaced to the right of center, there is now a net restorative force resulting from the bodies' 200,300 respective fields that tends to push the displaced body 200 to the left (negative y-force vector); i.e. back toward the center. Conversely, in FIGS. 4*a-b* when the body 200 is displaced to the left of center, there is a net restorative force in the opposite direction (positive y-force vector), which tends to push the displaced body to the right, again restoring the body 200 to its central alignment. There is also a very minor torque calculated in the arbitrary units that are used, of magnitude {±0.1,0,0} depending on whether the body 200 is displaced to the right or the left.

Figure 5A:
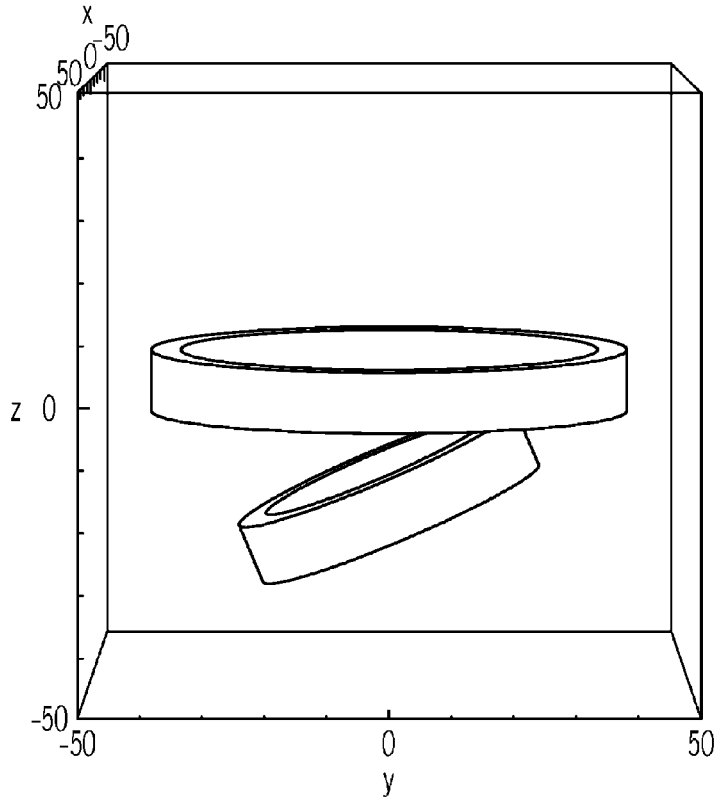
FIGS. 5*a*-5*b* are similar to FIGS. 2*a*-2*b*, but with the body 200 being rotationally displaced about its own x-axis.
Figure 5B:
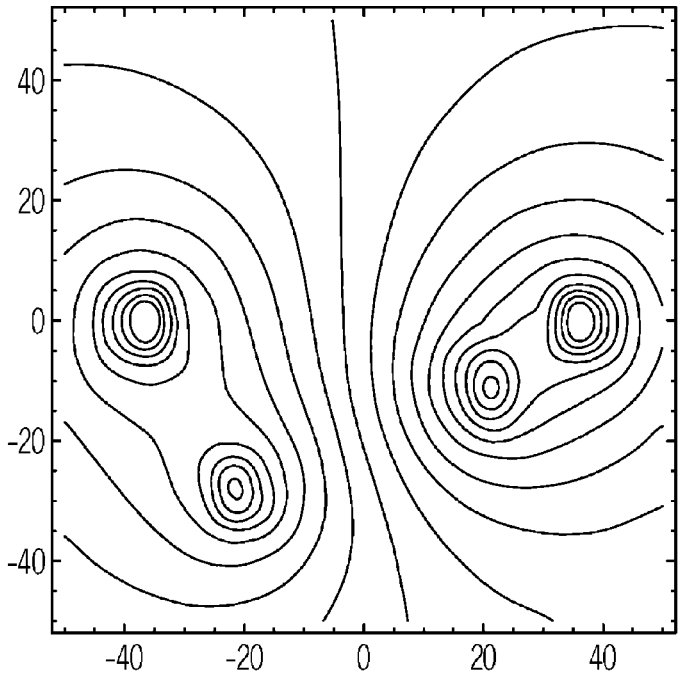

Referring now to FIG. 5, in the illustrated arrangement the bodies 200 and 300 are axially spaced substantially similarly as in FIGS. 2-4, but the body 200 is rotationally displaced about its own x-axis as shown. Such a misalignment could lead to contact of the bodies 200, 300. Based on the field lines shown in FIG. 5*b*, the calculated force vectors in the same arbitrary units as above are {0, 5, 16}, and the calculated torque vectors are {−0.1, 0, 0}. The negative torque about the x axis tends to turn the smaller body 200 in the clockwise direction in the figure, which is the direction that would lead to re-alignment of the body 200, to restore its coaxial alignment with the larger body 300. At the same time, the positive force in the y direction acts to push the projectile into the wall. However, after the rotation has been corrected, the translational force from the center will also be corrected, as seen for the cases illustrated and discussed above with respect to FIGS. 3 and 4.

Hence, based on the cases discussed above with respect to FIGS. 2-5, it can be seen that when the magnetic fields of the bodies 200 and 300 attract one another, they will tend to sustain or restore their coaxial alignment in the event the body 200 becomes displaced relative to their common axis. The lateral (x- and y-) force vectors produced from displacing the body 200 from its common central (z) axis with the larger body 300 tend to restore the body 200 to its centrally-aligned position, eliminating its displacement. It will therefore be appreciated that attractive magnetic forces between the bodies 200 and 300 will tend to inhibit physical contact, and sustain their coaxial alignment. This is not the case when the magnetic fields between the bodies 200 and 300 are repulsive, as explained below with respect to FIGS. 6-8.

Figure 6A:
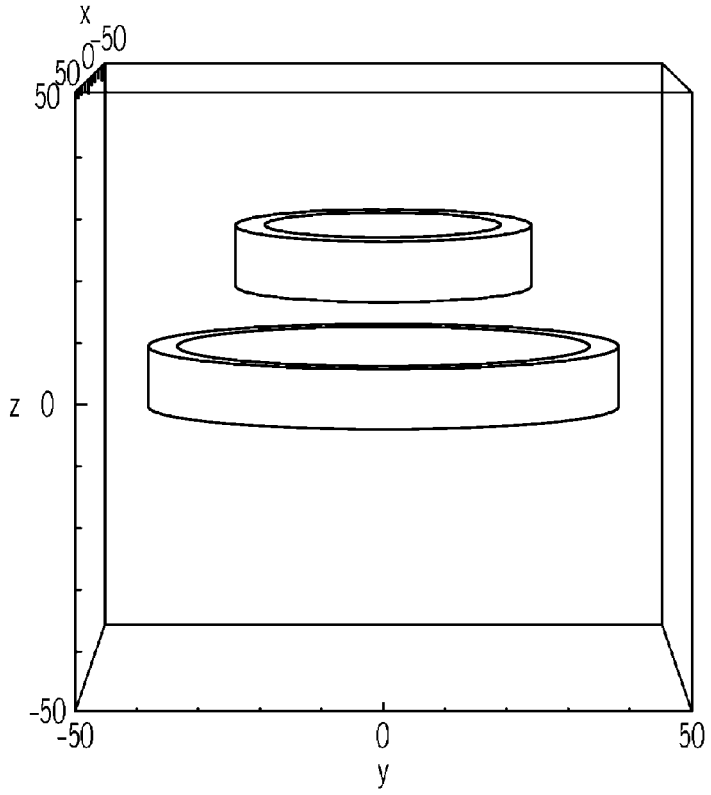
FIGS. 6*a*-6*b* illustrate arbitrary field source bodies 200 and 300 having repulsive magnetic fields, which are aligned coaxially and spaced an axial distance from one another. Their relative positions are shown in FIG. 6*a* and the corresponding magnetic field lines taken along a central y-z cross-section are shown in FIG. 6*b*.
Figure 6B:
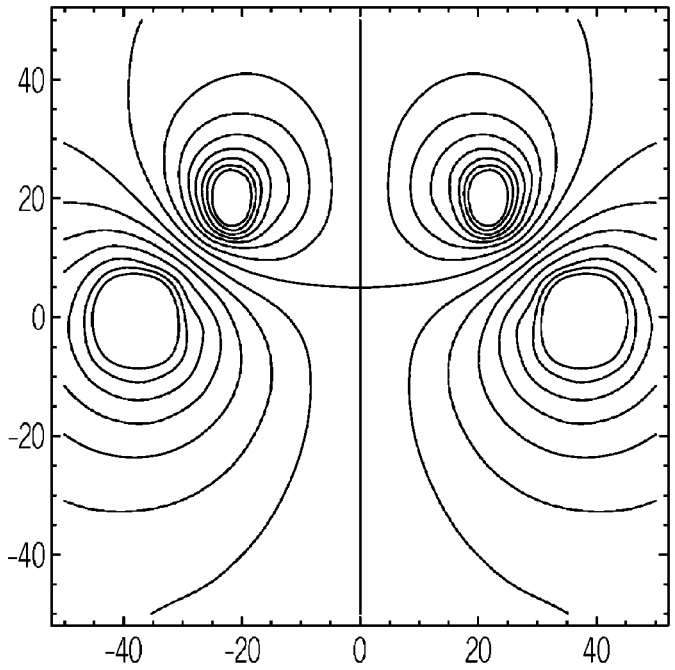

Referring now to FIG. 6, the spatial arrangement is the opposite of FIG. 2, with the larger body 300 below the smaller body 200 on the page. The magnetic fields are repulsive. Similarly as in FIG. 2*b*, the field lines in FIG. 6*b* are symmetric about the common central axis of the bodies 200 and 300; the calculated force vectors in the same arbitrary units as above are {0, 0, 18}, and the calculated torque vectors are {0,0,0}. The force in the positive z direction is toward the top of the page in the figure, resulting from the repulsive force. The principal difference from FIG. 2, where the fields were attractive, is that in FIG. 6*b* the field lines are concentrated substantially between the bodies 200 and 300, instead of commonly enclosing those bodies. In the case where the field lines are substantially between bodies instead of commonly enclosing them, it is more helpful to think of the field lines as acting as a compressed gas, with higher densities of field lines producing a larger force (Martin N. Wilson, *Superconducting Magnets*, Oxford University Press, 1987, p. 41). The lines between the bodies 200 and 300 are being compressed, leading to a repulsive force.

As noted above, when the bodies 200 and 300 having repulsive fields are perfectly concentric, their corresponding magnetic fields (field lines in FIG. 6*b*) are symmetric about their common axis. This means that no net x- or y-force vectors exist that would tend to deflect the body 200 into the body 300. However, as will be seen, even slight mis-alignment will result in deflecting the body 200 laterally into contact with the body 300. Because the bodies 200 and 300 repel each other, as they are forced closer together (as will be the case when a projectile 10 approaches a conductive tube 20) the repulsive force renders it more likely that the body 200 will be deflected from perfect concentricity with the body 300.

Figure 7A:
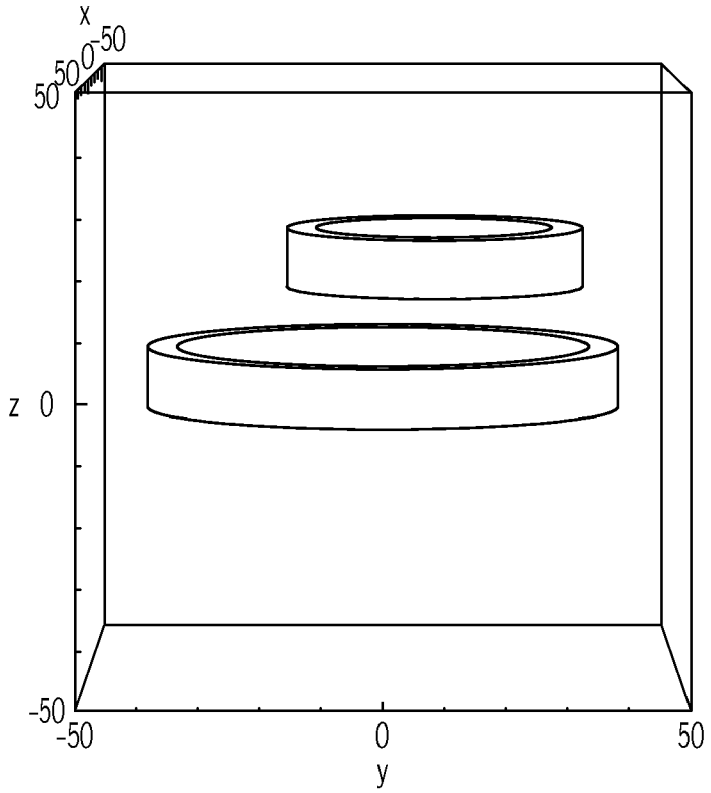
FIGS. 7*a*-7*b* are similar to FIGS. 6*a*-6*b*, but with the repulsive bodies 200 and 300 arranged such that the body 200 is displaced radially off center relative to the body 300.
Figure 7B:
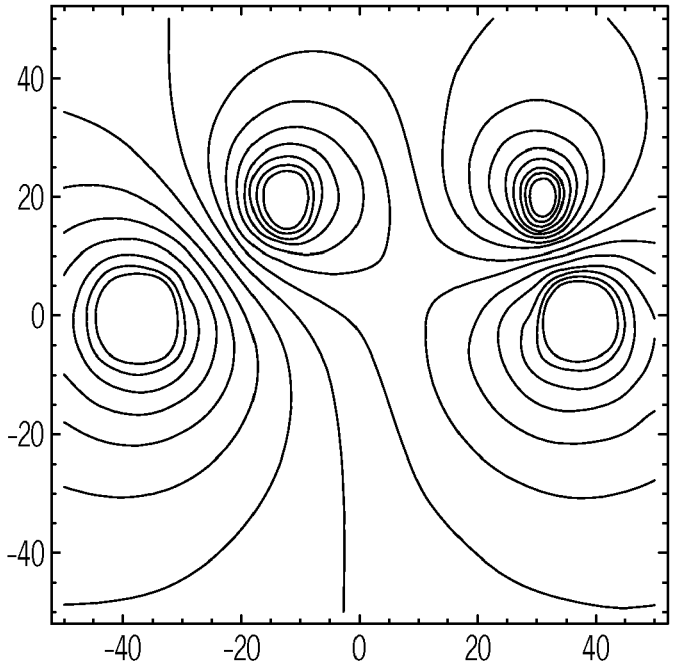

Now referring to FIG. 7, the body 200 is displaced off center to the right as seen in FIG. 7*a*, resulting in field lines as shown in FIG. 7*b*. The calculated force vectors based on the field lines for this case in the same arbitrary force units as above are {0, 3, 19}; the calculated torque vectors are {0.1, 0, 0}. Referring to FIG. 7*b*, the +3 y-force vector is in the same direction as the off-center displacement of the body 200. This means that for a lateral deflection when bodies 200 and 300 repel one another, the resulting y-force vector will push the body 200 further in the direction of the deflection and toward the body 300, instead of re-centering it. Qualitatively, the force in the y direction can be attributed to the field lines that encircle the right side of the body 300 and the left side of the smaller body 200. According to the stretched-rubber-band analogy, this produces a force toward the right. This is expected because the currents through both bodies 200 and 300 on the right-side of the cross-section in FIG. 7*b* are flowing in the same direction (either into or out of the page). Thus, when the magnetic fields are repulsive, a lateral deflection of the body 200 from the common central z-axis will be compounded by a force vector in the direction of the deflection, rendering the lateral deflection unstable. This will be to drive the body 200 into the body 300, causing impact.

Figure 8A:
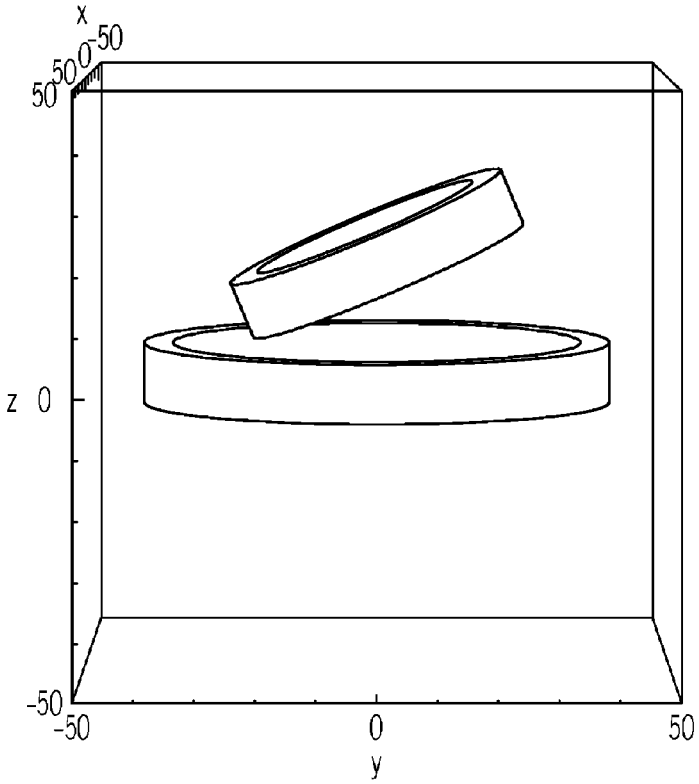
FIGS. 8*a*-8*b* are similar to FIGS. 6*a*-6*b*, but with the body 200 being rotationally displaced about its own x-axis.
Figure 8B:
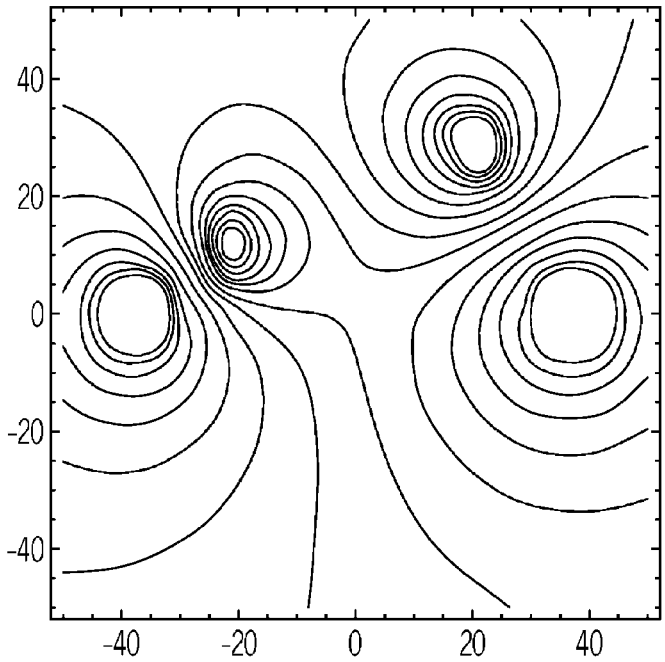

FIG. 8 illustrates an arrangement where the bodies 200 and 300 are axially spaced substantially similarly as in FIGS. 6-7, but the body 200 is rotationally displaced about its own x-axis (counter-clockwise on the page) as shown. Based on the field lines shown in FIG. 8*b* in the arbitrary units, the calculated force vectors are {−1, 5, 16}, and the calculated torque vectors are {0.1, 0, 0}. The torque about the x axis tends to turn the smaller body 200 in the counter-clockwise direction in the figure, thus compounding the rotational mis-alignment. Qualitatively in FIG. 8*b*, field lines can be seen encircling the left side of the body 200 and the right side of the body 300, tending to turn the projectile counter-clockwise. Thus, similar to a lateral displacement as seen above in FIG. 7, a rotational mis-alignment when the bodies 200 and 300 repel one another is also unstable. In addition, the x- and y-force vectors produced from a rotational mis-alignment will further deflect the body 200, with the sum of these effects being to cause the body 200 to tumble into the larger body 300 if the latter represents a tube through which the first body 200 is traveling.

From the foregoing discussion with reference to FIGS. 2-8, it will be appreciated that the leading magnetic field $B_2$ in FIG. 1, which repels the magnetic field $B_0$ of the projectile 10, will tend to deflect the projectile 10 into the wall of the receiver 19 (conductive tube 20). Conversely, the trailing magnetic field $B_1$, which attracts the field $B_0$, will tend to position the projectile 10 such that the two fields $B_0$ and $B_1$ are concentric. In the preferred case where the trailing field $B_1$ is symmetric with respect to the passageway 26 of the receiver 19 and the body-associated field $B_0$ is symmetric with respect to the projectile 10, the centering action of the attractive fields $B_1$ and $B_0$ will tend to center the projectile 10 along a concentric axis and the center of the passageway, thus inhibiting or at least reducing the tendency for contact while the projectile 10 is traveling relative to (through) the receiver 19.

It is desirable to inhibit or eliminate the induction of the leading magnetic field $B_2$ ahead of the projectile 10 as it travels through the receiver 19. At the same time, it is desirable to continue to induce the trailing magnetic field $B_1$ to generate braking force to decelerate the projectile 10.

Figure 9:
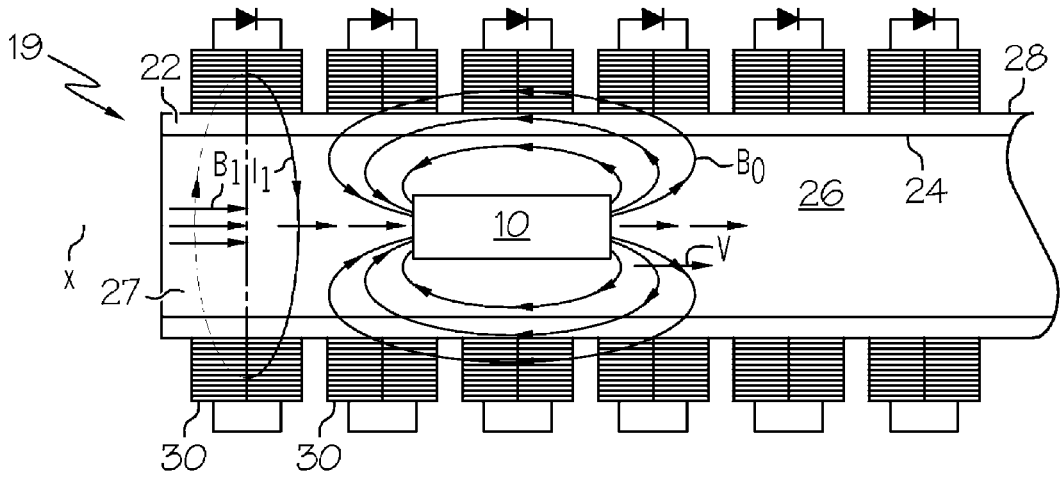
FIG. 9 is a schematic side view, partially in section, of an embodiment of an inductive braking system as disclosed herein.

Referring now to FIG. 9, an exemplary embodiment of an inductive-braking system is illustrated. In this embodiment, a receiver 19 includes a non-conductive cylindrical form 22 whose interior surface 24 defines a deceleration passageway 26 adapted to receive the projectile 10, which is traveling therethrough in the direction V from an open end 27. The diameter of the interior surface 24 is large enough to ensure no contact between the projectile 10 and that surface 24 when the body is centered within the passageway 26, as described herein. The non-conductive cylindrical form 22 is made of a non-conductive material, such as non-conductive plastic. At least one unidirectional conductor 30 is disposed circumferentially around the exterior surface 28 of the non-conductive form 22. Each unidirectional conductor 30 has a closed conductive pathway that permits current to flow in substantially only one direction. The unidirectional conductor(s) is/are arranged so that the passageway 26 passes through it/them so that the closed conductive pathway(s) of the conductor(s) encircle(s) the longitudinal axis X of the passageway 26. By 'encircles,' it is meant that the conductive pathway of a conductor 30 travels around the longitudinal axis X of the passageway 26. The conductive pathway need not travel along a circular path around the axis X, although this is preferred. For example, the conductive pathway may follow a square or other polygonal or curvilinear path around the axis X. By 'closed' conductive pathway, it is meant that each pathway defines a closed circuit for the flow of electrons. Each unidirectional conductor 30 permits the flow of current in substantially only one direction (inhibiting current flow in the opposite direction) through its conductive pathway around the axis X of passageway 26. That is, current is permitted to flow substantially only in the direction that will induce the attractive trailing magnetic field $B_1$ in FIG. 1 based on the polarity of the magnetic field $B_0$, and not the repulsive leading magnetic field $B_2$ in that figure. Note that the direction in which the conductor 30 is to allow current to flow cannot be determined without first knowing the polarity of the magnetic field $B_0$ associated with the projectile 10 and its direction of travel. Once these parameters are determined, the unidirectional conductor(s) 30 is/are provided based on the changing magnetic flux produced from the field $B_0$ as the projectile 10 travels through the passageway 26.

Figure 10A:
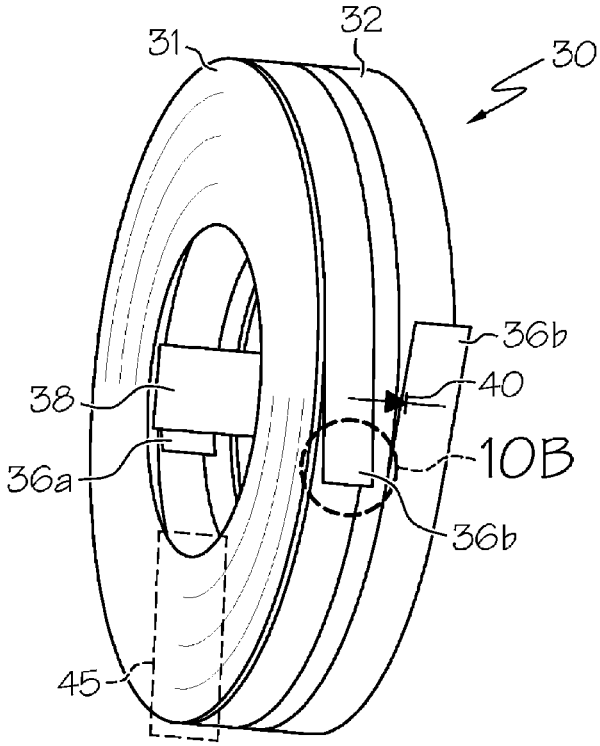
FIG. 10*a* is a perspective view of an exemplary unidirectional conductor 30 as disclosed herein, which includes a pair of adjacent windings 31 and 32 of flat strips of conductive material connected to form a closed circuit via a diode that allows current to flow in substantially only one circumferential direction through the windings.
Figure 10B:
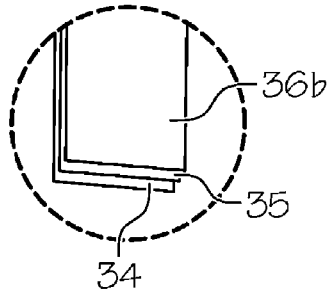
FIG. 10*b* is a close-up of a terminus of one of the winding 31 taken at the broken circle in FIG. 10*a*.

As most clearly seen in FIGS. 9 and 10, in a preferred embodiment a unidirectional conductor 30 is made from two adjacent windings 31 and 32 of flat strips of conductive material. Each strip includes a layer of conductive material 34 and a layer of insulating material 35, such that adjacent turnings of the conductive material 34 in each winding 31,32 do not contact one another and create a short circuit. Each winding includes an inner terminus 36*a* and an outer terminus 36*b*, with the outer terminus 36*b* being radially more distant from the central axis of the windings 31,32. The two windings 31 and 32 are arranged concentrically at adjacent axial positions relative to one another, such that the deceleration passageway 26 passes through the center of both the windings 31,32. A conductive interconnect 38 provides a conductive connection between the inner termini 36*a* of the windings 31,32. The interconnect 38 preferably is made from the same conductive material as for the layer of conductive material 34 in the windings 31,32. Ideally, the electrical resistance of the interconnect 38 is lower than that of the conductive material 34. A diode 40 is electrically connected between the outer termini 36*b*. The diode 40 will permit current to flow through the unidirectional conductor 30 (i.e. from the first winding 31, through the diode 40 into and through the second winding 32, then through the interconnect 38 back to and through the first winding 31) in substantially only one direction. Optionally, instead of interconnect 38, another diode 40 can be used to connect the inner termini 36*a*. If desired, multiple parallel diodes also may be used between adjacent termini to ensure against system failure if one diode fails.

In a further alternative, only a single winding 31 need be used. In this embodiment, the interconnect 38 is not required, and the diode 40 is electrically connected directly between the inner and outer termini 36*a* and 36*b* to ensure unidirectional current flow. The double-winding embodiment (windings 31 and 32) described above may be preferred to avoid having to provide a diode connection between the inner and outer termini 36*a* and 36*b* of a single winding, which may be distant from one another. The geometry of the system also may make it more difficult or cumbersome to provide and isolate a conductive diode pathway from the termini 36*a*,36*b* of a single winding.

Figure 11:
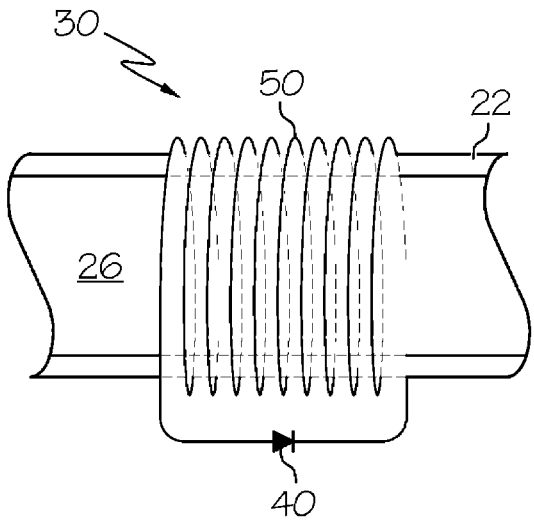
FIG. 11 is a perspective view of a further exemplary embodiment of a unidirectional conductor 30, which includes a wire wound in a helical pattern to substantially define a cylindrical form, wherein the ends of the wire are connected to form a closed circuit via a diode that allows current to flow through the wire in substantially only one circumferential direction.

In another exemplary embodiment shown in FIG. 11, the unidirectional conductor 30 can be a length of insulated wire 50 that is wrapped around the non-conductive cylindrical form 22, with a diode 40 electrically connected between the wire's opposite ends to permit current to flow through the wire 50 in substantially only one direction. The embodiments using one or two winding(s) 31 (and 32) of flat strip(s) described above and illustrated in FIG. 10 are preferred to this construction, because the former embodiments provide an increased packing factor compared to a wound wire. The packing factor is defined as the conductive cross-sectional area divided by the total cross-sectional area (conductive+ insulating) of the unidirectional conductor 30 parallel to the conductive pathway. This area is measured in an imaginary plane 45 as seen in FIG. 10. The greater the packing factor, the lower the resistance to induction of the current $I_1$ based on the magnetic flux gradient from traveling field $B_0$, and the more efficiently the trailing magnetic field $B_1$ will be induced.

The non-conductive cylindrical form 22 in all the foregoing embodiments is optional. That is, either the winding(s) 31 (and 32) or a solenoid-wound wire 50 itself/themselves can define the deceleration passageway 26, without the need of the cylindrical form 22. However, the cylindrical form 22 may be preferred in the unlikely event of a collision with the projectile 10, because such a collision may result in greater damage to the unidirectional conductor(s) 30 were it/they to be impacted directly, particularly by a hypervelocity projectile 10.

Multiple unidirectional conductors 30 can be disposed at axially-spaced intervals along the length of the deceleration pathway 26 (which runs through their respective centers) as illustrated in FIG. 9. In this embodiment, as the projectile 10 and its associated magnetic field $B_0$ travel in the direction V, the electrical current $I_1$ and magnetic field $B_1$ are induced successively in the conductors 30, in the direction V, trailing the position of the field $B_0$. In another alternative, a single unidirectional conductor 30 composed of one or more axially-adjacent windings 31,32 can be used, whose axial length corresponds to the full length of the deceleration passageway 26 through which deceleration of the projectile 10 is desired. In this embodiment, the current $I_1$ and magnetic field $B_1$ will be induced in the single conductor 30 at a location behind the projectile 10 (or its magnetic field $B_0$). Because the conductor 30 now extends the full length of the deceleration passageway 26, if the conductor 30 includes flat layer(s) 34 as in the windings 31 and 32 then some of the current $I_1$ may flow through portions of the conductor 30 at axial locations adjacent or even ahead of the projectile 10. However, that current and the associated magnetic field $I_1$,$B_1$ will be focused at a position trailing the projectile 10 as it travels, thus producing the desired deceleration effect.

Figure 12:
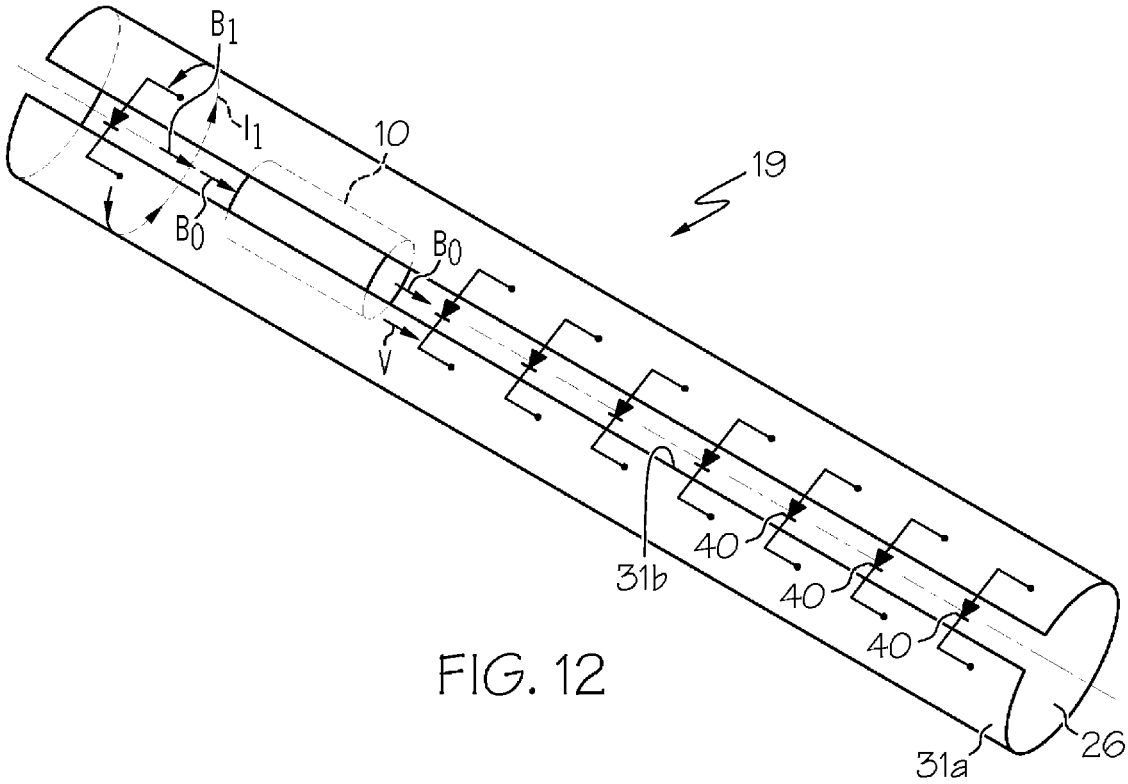
FIG. 12 is a perspective view of still a further exemplary embodiment of a unidirectional conductor 30, in which a cylinder 31*a* made of conductive material is discontinuous along a longitudinal slit, wherein one or more diodes 40 are connected to the opposite cylinder edges across the slit to thereby permit current to flow circumferentially through the cylinder 31*a* in only one direction.

In a limiting case of the preceding example embodiment, the single conductor 30 can be reduced to a single layer having just one turning of a conductive layer of material around the deceleration passageway 26. In this limiting case, illustrated in FIG. 12, the single unidirectional conductor 30 can be a cylinder 31*a* made of a conductive material and having a longitudinal slit 31*b* extending the length of the cylinder. Such a cylinder 31*a* can be formed, for example, by folding a flat sheet of conductive material into a cylindrical form, so that opposing edges approach but remain circumferentially spaced from one another by a selected arc length, thereby defining the longitudinal slit 31*b* mentioned above. One or a series of diodes 40 is/are provided to bridge the slit 31*b*, which will permit current to flow across the slit 31*b*, and therefore through the cylinder 31*a*, in substantially only one circumferential direction similarly as explained above. In this embodiment, it will be desirable to utilize a series of parallel diodes 40 to connect the opposed edges across the slit at spaced axial intervals along its length as shown in FIG. 12. This will prevent incapacitating the cylinder to act as a unidirectional conductor 30 should one diode fail, and also to shorten the current path-length for a current, $I_1$, induced at a position trailing the projectile 10 (or field $B_0$). That is, it is desirable that the current, $I_1$, take as circumferential a path as possible around the passageway 26 in the vicinity trailing the projectile 10. Alternatively, if only a single diode 40 or a small number of diodes 40 is/are used, then the apparent resistance at a given axial location will depend on the position of the projectile 10 and its associated magnetic field $B_0$, because the current will have to travel lengthwise (axially) through the cylinder 31*a* to get to the diode(s) 40 and complete the circumferential circuit. This will affect the braking force exerted on the projectile 10 relative to its position to the diode(s) 40. Based on this, the placement of one or several diodes (40) could be selected, e.g. through trial and error, to tailor the deceleration profile of the projectile 10 through the cylinder 31*a*.

When using a winding 31 (or windings 31,32) of flat conductive material in a unidirectional conductor, whether to use a single such conductor 30 as seen in FIG. 12 or multiple axially-spaced conductors 30 as seen in FIG. 9 may depend on the scale of the deceleration passageway 26 that is needed. For a relatively small projectile that will require a deceleration passageway of a few inches diameter and a few inches to one or several feet in length, it may be practical to utilize a single unidirectional conductor having one winding 31, or having axially-disposed first and second windings 31 and 32 as described above and illustrated in FIG. 10. Conversely, for a larger and/or faster (e.g. hypervelocity) projectile that will require a deceleration passageway of longer length, perhaps hundreds of feet, then manufacturing considerations may dictate that multiple discrete and axially-spaced unidirectional conductors 30 be used. Separately, using multiple unidirectional conductors 30 comprised of windings 31,32 may be desired to tailor the deceleration profile of the projectile 30 through the receiver 19.

Whether one or multiple unidirectional conductor(s) 30 is/are used, the number of turnings of the flat conductive material (i.e., the number of times the material is wrapped around itself to produce successive circumferential layers encircling the deceleration passageway 26) will depend on balancing the competing factors of the resulting resistance and inductance. The greater the number of turnings, the greater will be the conductive path length. A greater path length will produce both increased resistance and increased inductance. Increasing the resistance will reduce the response time for inducing the magnetic field $B_1$, but it will increase the capability of the conductor 30 to dissipate thermal energy. This latter property will be desirable particularly in the case of decelerating hypervelocity projectiles, for which significant magnitudes of kinetic energy will be converted to and absorbed by the conductor(s) 30 as thermal energy. Separately, increased inductance will increase the response time to induce the flow of electrons through the conductor(s) 30 that will produce the electrical current $I_1$ in response to the magnetic flux produced by the moving field $B_0$. In addition, the greater the number of turnings (radial layers) the lower the skin effect from the induced current (described below). These competing factors (increased heat-dissipative capacity versus reduced response time with conductive path length) can be balanced to achieve an optimal path length, and corresponding number of turnings, on a case-by-case basis depending on the inertia that must be counteracted to slow the projectile 10 within the available or desired distance.

In the embodiment utilizing a coiled wire 50 to provide the unidirectional conductor(s) 30 as seen in FIG. 11, the same considerations as above will dictate the length of the wire 50. As will be appreciated, however, numerous turnings of wire 50 will be necessary to achieve an effective axial length for a conductor 30 compared to using a flat strip, whose axial dimension will be much longer than for a wire 50 on a similar scale (similar scale here referring to a wire having a conductive diameter similar to the height of a flat strip in the radial dimension). Hence, a significantly greater number of turnings (conductive length) of wire compared to a flat strip of similar scale may be necessary to provide a unidirectional conductor 30 having comparable axial length (in the direction of the axis X), to provide braking force over a similar axial distance. As will also be appreciated, a wire 50 will have substantially reduced cross-sectional area for conduction compared to a flat strip of similar scale, which will produce a correspondingly greater resistance even for the same number of turnings (conductive length). These factors, in addition to a substantially reduced packing factor compared to winding(s) 31,32 of a flat conductive strip, suggest that a coiled wire 50 will be less preferred for practical applications of a receiver 19 having one or more unidirectional conductors 30 to provide inductive braking force of a high-speed or hypervelocity projectile.

It is noted that in FIG. 1, both the fields $B_1$ and $B_2$ exert a braking force on the projectile 10; the trailing field $B_1$ attracts the projectile from behind, opposite its direction of travel, V, and the leading field $B_2$ repels the projectile from the front, again opposite its direction of travel. For this reason eliminating the leading field $B_2$ to reduce the tendency to displace the projectile 10 laterally into the receiver 19 may be expected to reduce the effective braking force by about half. However, using a wound conductive material such as a wound conductive layer 34 in windings 31,32, or a current-carrying wire 50, it is believed that elimination of the skin effect may compensate, perhaps more than compensate, for the absence of the leading magnetic field in terms of effective braking force. The skin effect refers to the tendency of a changing flow of electrons traveling through a conductive material (such as the conductive tube 20 in FIG. 1) to be concentrated at the surface. Because the electron flow is concentrated at the surface, the effective cross-sectional area of electron flow is low, resulting in high effective resistance. This high resistance results in a lower induced current (e.g. $I_1$), which in turn produces a weaker magnetic field (e.g. $B_1$). Using a conductor 30 whose radial dimension comprises numerous turnings of the conductor, the current is forced to travel through the depth of that conductor 30 instead of being substantially confined at or adjacent its surface proximate the deceleration passageway, resulting in a higher effective cross-sectional area for flow and correspondingly reduced resistance. This means that for a given magnetic field $B_0$ of the projectile 10, the induced current $I_1$ will be higher, resulting in a stronger trailing magnetic field $B_1$, compared to the field that would be generated based on a solid conductive tube 20 due to the reduced skin effect. It is noted that the foregoing does not apply to the embodiment illustrated in FIG. 12, which comprises a single layer (i.e. turning) of conductive material that has been bent to a cylindrical conformation. The skin effect would be expected to be more prevalent in the FIG. 12 embodiment than in those illustrated in FIGS. 10 and 11. For a given braking requirement (based on the inertia to be stopped), this means a receiver 19 according to the embodiment illustrated in FIG. 12 may need to be longer than that of embodiments illustrated in FIGS. 10 and 11. These factors should be considered when designing and sizing a receiver 19 to brake a particular projectile 10 traveling at a particular speed.

The operation of the receiver embodiments thus far described has assumed as a preferred case that the unidirectional conductor(s) 30 are cylindrical (or circular) and centered about a central axis X of the deceleration passageway 26. The described operation has also assumed that the magnetic field $B_0$ associated with the projectile 10 is symmetric with that projectile. Under these assumptions, when the fields $B_0$ and $B_1$ are concentrically aligned, the projectile 10 will be centered within the passageway 26. However, it will be appreciated that this preferred case is not required. For example, the unidirectional conductor(s) 30 may have some other shape, for example square, rhombic or some other closed polygonal or curvilinear shape that encircles the axis X or passageway 26. In such instances, the induced magnetic field $B_1$, produced from current $I_1$ traveling through a non-circular or asymmetric conductor 30, may not be symmetric with the axis X of the deceleration passageway 26. It is also noted that the magnetic field $B_0$ need not be symmetric with respect to the projectile 10, in which case the body's 10 geometry may be off-center relative to the passageway 26 when the fields $B_0$ and $B_1$ are aligned. In all instances, it is desirable that the geometry of the conductor(s) 30, and the position of the field source for generating the field $B_0$ associated with/attached to the projectile 10 (relative to that projectile 10) are selected to ensure that when the fields $B_0$ and $B_1$ are energized and thereby caused to align, the projectile 10 is not in contact with the receiver 19 or any portion thereof exposed to or defining the deceleration passageway 26, for example the inner wall 24 of the cylindrical form 22, if present.

The foregoing receiver constructions can be scaled to provide braking force to a variety of projectiles 10 based on the projectile's inertia. For example, Bennett et al. investigated and provided correlations for determining the required stopping distance for a projectile of known inertia (mass times speed) based on the strength of the magnetic field $B_0$ associated with the projectile 10 traveling through a conductive tube 20, as well as other system parameters (described in the Examples below). The best permanent magnets produce a magnetic field strength of approximately 0.5 Tesla. The field strengths of permanent magnets, such as NdFeB monoliths, may be sufficient to stop a projectile of modest inertia (e.g. mass of several kilograms and traveling up to perhaps several hundred meters per second) within a reasonable distance. However, in one application of interest, wherein a receiver 19 is utilized to arrest a hypervelocity projectile having a large inertia, such field strengths may not produce sufficient braking force to achieve a reasonable stopping distance. Conventional electromagnets can be used to achieve very high field strengths, but only when supplied current from a power source. It is therefore desirable in certain embodiments, particularly to arrest hypervelocity projectiles, to employ a persistent-current superconducting magnet as the field source for generating the magnetic field $B_0$ associated with a hypervelocity projectile 10.

Figure 13:
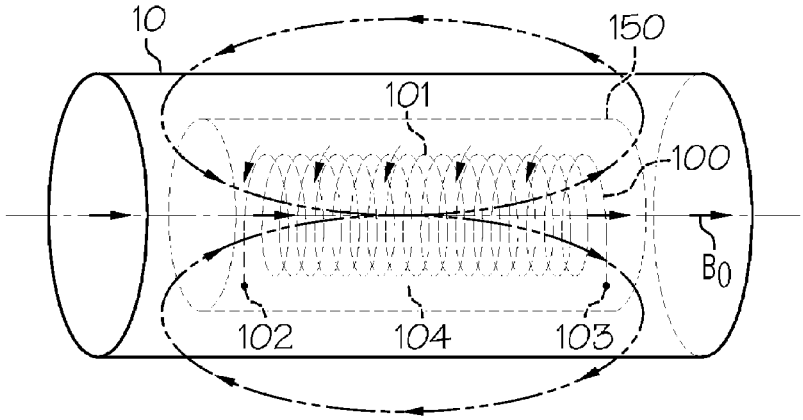
FIG. 13 schematically illustrates a projectile 10 having a superconducting field source 100 therein or associated therewith, which field source 100 is in the form of a solenoid coil whose ends are connected via a persistent current joint to form a closed circuit through the coil.

Persistent-current superconducting magnets are superconducting materials in which a current has been induced in a circular path, and persists because the superconducting material exhibits zero or virtually zero resistance. In one embodiment, the field source 100 is a superconducting magnet in the form of a closed solenoid coil 101 of superconducting material, wherein the ends 102 and 103 of the coil 101 are connected to one another via a persistent current joint 104 as known in the art and illustrated schematically in FIG. 13. Persistent current joints themselves are made of superconducting material, and ensure a zero- or substantially zero-resistance for the flow of current across the joint from one end 102 of the coil to the other end 103 to complete the circuit. In FIG. 13, a persistent-current superconducting solenoid coil magnet 101 is shown schematically mounted in or attached to a projectile 10 that is to be decelerated via inductive braking in a receiver 19. Preferably, the coil 101 substantially defines a cylinder whose longitudinal axis is parallel to, preferably concentric with, the longitudinal axis of the projectile 10. Alternatively, the coil 101 need not be cylindrical, but instead can define another polygon or other curvilinear closed shape in cross-section. Once a current $I_0$ is induced through the coil 101 along a closed path around a central axis (which will be an axis of symmetry if the coil cross-section is uniformly circular or a regular polygon), such as a circular path in the case of a cylindrical (helical) coil 101, the current $I_0$ will induce a magnetic field $B_0$ that will persist indefinitely, so long as the current $I_0$ through the coil 101 persists (i.e. so long as the coil 101 remains in a superconducting state).

Figure 14A:
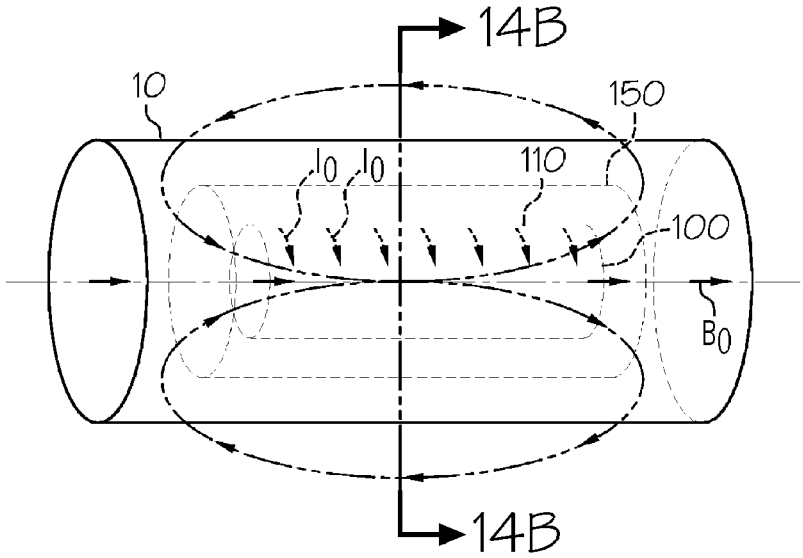
FIG. 14*a* schematically illustrates a projectile 10 having a superconducting field source 100 therein or associated therewith, which field source 100 is in the form of a cylindrical monolith.
Figure 14B:
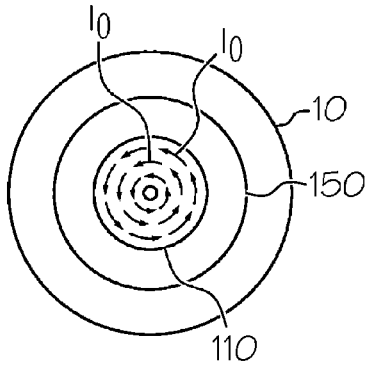
FIG. 14*b* is a cross-section taken along line 14*b*-14*b* in FIG. 14*a*.

In another embodiment, the persistent-current superconducting magnet used as the field source 100 can be in the form of a monolith 110 of superconducting material. FIG. 14 schematically illustrates a persistent-current superconducting monolith magnet 110 mounted in or attached to a projectile 10. In this embodiment, preferably the monolith 110 is in the form of a solid cylinder whose longitudinal axis is aligned (preferably concentric) with the longitudinal axis of the projectile 10. Similarly as in the solenoid coil embodiment, once a persistent current $I_0$ has been induced along a circular path in the monolith 110, the resulting magnetic field $B_0$ will be induced.

Figure 15:
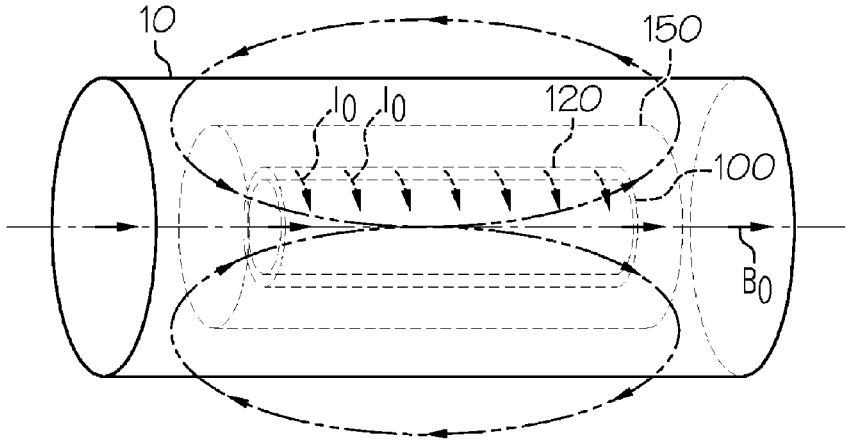
FIG. 15 schematically illustrates a projectile 10 having a superconducting field source 100 therein or associated therewith, which field source 100 is in the form of a sleeve extending along an axis that is parallel to the long axis of the projectile 10.

In a further embodiment, the persistent-current superconducting magnet used as the field source 100 can be in the form of a closed sleeve 120, for example and preferably a cylindrical sleeve as seen in FIG. 15. The superconducting sleeve 120 can be hollow at the center or it may enclose a non-conductive core (not shown). Similarly as above, the persistent current $I_0$ induces a corresponding magnetic field $B_0$, which will persist so long as the sleeve 120 remains in the superconducting state. Other embodiments of a superconducting magnet as the field source 100 are possible and could be used.

Regardless of the particular embodiment, when a superconducting magnet is used as the field source 100, it is desirable to employ a high-temperature superconductor as the superconducting material, such as a material selected from the class of $YBa_2Cu_3O_{7-\delta}$ (YBCO) superconducting materials. Such materials are referred to as 'high-temperature' superconductors because they can be made superconducting at relatively high cryogenic temperatures, such as 77K, which conveniently is the boiling point of nitrogen at standard pressure. YBCO materials typically can produce magnetic field strengths as high as about 3.7 Tesla at 77K. Fields of greater strength can be produced from YBCO materials cooled to lower temperatures. For example, a field of 11 Tesla can be produced by YBCO materials at 47K, and fields as high as 17 Tesla can be produced at 29K. Because the braking force resulting from the attraction between the induced magnetic field $B_1$ and the magnetic field $B_0$ of the field source 100 is proportional to the square of the field strength, a YBCO or other superconducting magnet can produce braking forces hundreds of times larger than comparably sized permanent magnets.

High-temperature superconductors are preferred because less cooling power must be used to cool and maintain them in a superconducting state compared to other known superconductors. However, other superconductors such as NbTi alloys can be used. Such alloys require temperatures <10K to become superconducting, and therefore may require substantial cooling power to sustain the superconductive state. If such power is available, a NbTi superconducting magnet could produce magnetic fields having field strengths as high as 8 Tesla, with correspondingly higher braking force. Alternatively, other superconducting materials may be used as the field source 100 for the magnetic field $B_0$. The superconducting material selected will depend on the magnetic field strength required to arrest the hypervelocity (or other) projectile in the desired or available stopping distance based on the projectile's inertia, and the electrical and physical properties (inductance, conductivity, dimensions) of both the field source 100 and the element(s) of the receiver 19 responsible for supplying the induced current and magnetic field $I_1$ and $B_1$; e.g. unidirectional conductor(s) 30 or conductive tube 20. It is noted that a superconducting magnet can be used as the field source 100 for the field $B_0$ whether a conductive tube 20 as shown in FIG. 1 or unidirectional conductor(s) 30 as seen in FIGS. 9-12 is/are used. Unidirectional conductor(s) 30 are preferred in applications where it is desirable to avoid deflecting the projectile 10 into the receiver 19. However, this may not be a concern in some applications, for example if the projectile 10 and receiver 19 are in a fixed sliding relationship such as via a track system or if the projectile 10 slides through a tube 19 of complementary inner diameter.

Figure 16:
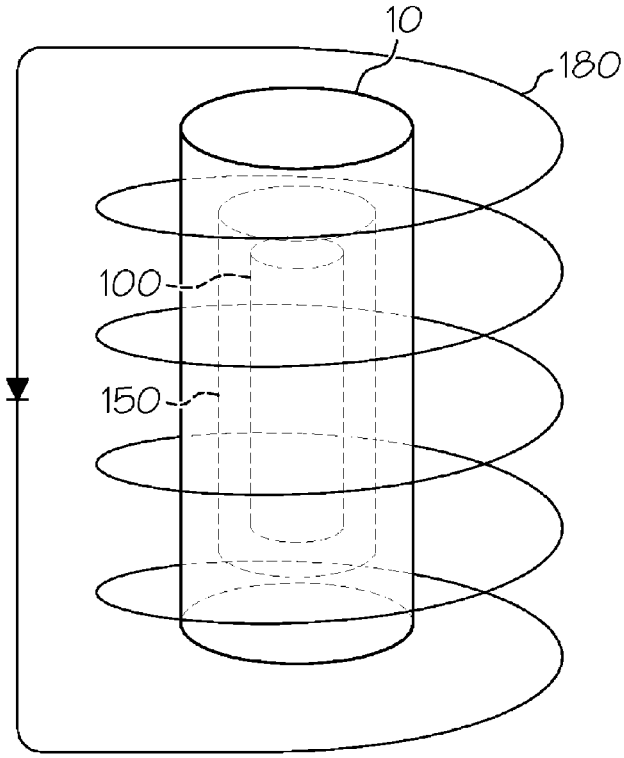
FIG. 16 schematically illustrates a projectile 10 having a superconducting field source 100 therein or associated therewith, positioned within an external field generator 180 for generating an external magnetic field to induce a magnetic field in the superconducting field source.

Regardless which embodiment (e.g. the forms illustrated in FIGS. 13-15 or some other form) of a superconducting magnet is selected for the field source 100, in order for it to function as a generator for the field $B_0$ it must have a persistent current traveling through it in a circular (helical) path. The persistent current can be induced either via application of an external magnetic field or by applying a voltage directly to the superconducting magnet via a persistent current switch. In the external-field method, an external magnetic field is applied to the superconducting field source 100. The external field will induce a current in the field source 100, which current will produce its own magnetic field emanating from the field source 100 after the external field has been removed. To apply the external field, the field source 100 can be positioned in or proximate to an external field generator such that its longitudinal axis is aligned (preferably concentric) with the external field to be applied. This is shown schematically in FIG. 16. In that figure, the entire projectile 10 carrying the field source 100 is positioned within an external field generator 180. This is not required, however, and the field source 100 may be positioned in the field generator 180 alone, and then placed in or attached to the projectile 10 after the field $B_0$ has been induced. In the illustrated embodiment, the external field generator 180 is a conductive coil. The field source 100 is initially in a non-superconducting state when it is positioned within the external field generator 180. While the field source 100 remains in a non-superconducting state, the field generator 180 (e.g. the coil illustrated in FIG. 16) is energized such that a current circulates through it, resulting in an external magnetic field (so called because it is generated external, and applied, to the field source 100). After the external field has been applied, the field source 100 is cooled to a temperature at which it is or becomes superconducting. Once the field source 100 reaches a superconducting state, the external field generated by generator 180 is ramped down or removed to induce a persistent current (current $I_0$ shown in FIGS. 13-15) in field source 100, which produces its own magnetic field (field $B_0$ throughout the figures) having the same polarity as the applied field. The polarity of the induced field $B_0$ relative to the orientation of the projectile can be controlled by either regulating the voltage (i.e. current direction) in the external field generator 180 knowing that the two fields will have the same polarity, or otherwise positioning the projectile 10 within the generator 180 in either an upright or inverted position. The external magnetic field can be removed by gradually de-energizing the external field generator 180. Preferably, the external field is removed linearly until the applied field strength is zero. Because the field source 100 is a superconductive material, the induced current (and its associated magnetic field) will persist, subject to negligible losses, so long as it remains in a superconductive state. Once the external field generator 180 has been de-energized, the field source 100 (or the entire projectile 10) can be removed from the generator 180 and placed in a launcher, on a launch pad in the case of a rocket, etc. Alternatively, the external field generator 180 can be provided as part of a launcher or launch pad (not shown), and de-energized before launching the projectile 10.

As noted above, the external field generator 180 can be a conductive coil. This coil can itself be a superconductor. Preferably the current through it is controlled by applying an external voltage, which can be regulated to energize and de-energize the generator 180 as desired. Alternatively, the generator 180 need not be made of a superconductor but instead it can be made of a conventional conductor such as copper. This will increase the power required to induce the necessary current, because now the generator's 200 internal resistance will have to be overcome. It is important that the external field generator 180 can produce a magnetic field at least equal in magnitude to the field $B_0$ to be induced. This is because the induced field $B_0$ (based on the induced current $I_0$ through the field source 100) will be equal in magnitude to the applied external field, up to the limit in field strength (current $I_0$) for the superconducting material itself. For example, for a YBCO field source 100 capable of generating a field of 3.7 Tesla, the external applied magnetic field must be at least 3.7 Tesla to achieve the maximum field strength for the field source 100. If a lesser field strength, such as 2.0 Tesla is desired for the field $B_0$, then the external applied field should not exceed the lesser desired strength, e.g. 2.0 Tesla. Preferably, the magnetic field $B_0$ to be generated via a superconducting magnet as the field source 100 has a field strength of at least 2 Tesla, or at least 3 Tesla, or when using YBCO, of about 3.7 Tesla. Alternatively, greater field strengths are possible using YBCO superconductors at lower temperatures (explained below) or using stronger superconductor materials, such as at least 4, 5, 6, 8, 10, Tesla, or greater.

Alternatively to applying an external field, the field $B_0$ can be induced by applying a voltage to the superconducting field source 100 via a persistent current switch. After the voltage is applied and the desired current induced, the voltage is switched off and current continues to flow through the superconducting field source 100. In this embodiment, a power source for supplying the necessary voltage must be available to be connected to the persistent current switch. The power source may be carried on the projectile 10 if practical. Alternatively, it can be connected to the persistent current switch via electrical connections such as wires as known in the art, and then removed once the persistent current has been generated and the voltage removed.

Regardless how the persistent current, $I_0$, is induced, the superconducting field source 100 must be maintained at cryogenic temperature to sustain its superconductive state. This can be achieved, for example, by enclosing the field source 100 within a cooling jacket 150 (seen in FIGS. 13-16). The cooling jacket can be a vessel filled with a liquid cryogen, for example liquid nitrogen or liquid helium. The boiling point of liquid nitrogen is 77K as mentioned above. Therefore, enclosing the field source 100 within a cooling jacket 150 filled with liquid nitrogen will ensure that the field source remains at 77K or lower as long as the liquid lasts (does not boil off). The cooling jacket 150 can be vented to avoid rupture from nitrogen overpressure as known in the art. It is contemplated that for a relatively short trip, e.g. several minutes and even up to several days, a closed vessel containing liquid nitrogen or other cryogen and wrapped in suitable cryogenic insulation (e.g. aluminized mylar film, or enclosed within a vacuum) will be sufficient to ensure sufficient liquid cryogen remains between launch of the projectile 10 and the time when it is to be decelerated in a receiver 19. This should be sufficient for projectiles comprising payloads to be launched from Earth and intercepted by a receiver 19 in orbit, for example associated with a space craft, a satellite or space station. For longer trips, it may be necessary or desirable to apply active refrigeration to ensure sufficient cryogen remains during the trip so that the field source 100 remains superconducting by the time it is to be decelerated in a receiver. If active refrigeration is desired, the projectile 10 must be sufficiently large to accommodate the necessary refrigeration equipment. Suitable equipment to sustain cryogenic liquids at cryogenic temperatures is known in the art, for example as disclosed in U.S. Pat. Nos. 7,043,925, 7,347,053, 7,434,407, incorporated herein by reference.

As an alternative to using a persistent current superconducting magnet as the field source 100, either a conventional or superconducting electromagnet together with a power supply sufficient to produce the required field during braking could be used. The size of this power supply can be estimated based on the magnetic energy stored in the field produced by the magnet. This energy density is given by $$E_{vol}=B^2/2\mu$$

where B is the magnitude of the magnetic field, and $\mu$ is the magnetic permeability of the magnet and surrounding medium. For a field of 10 Tesla, with $\mu=4\pi\times10^{-7}$ H/m, the energy density is 40 MJ/m$^3$. Assuming magnet dimensions of: outer diameter=0.0508 m and length=0.0254 m (similar to the permanent magnet dimensions assumed for calculations in the Examples below), the stored energy would be roughly 2 kJ. This magnet would have a mass of about 0.4 kg. Energy storage for pulsed power supplies is usually provided by capacitors. Conventional capacitors have a specific energy storage of about 2 kJ/kg. Therefore, the energy storage for a 0.4 kg magnet would have a mass of about 1 kg, or a mass that is larger than the magnet (field source 100) by a factor of more than two. For this reason, persistent current superconducting magnets are preferred for the field source 100 in applications in which it is desired to minimize mass onboard the projectile 10.

In the foregoing discussion and the following Examples, the projectile 10 moves relative to a stationary receiver 19, such as a catch tube in the Examples, a conductive tube 20 or a receiver having unidirectional conductor(s) 30. However, it will be appreciated that the disclosed inductive-braking systems will work similarly as herein described in the case where it is the receiver 19 that is moving relative to a stationary projectile 10. This will be the case, for example, for a projectile 10 that is launched from Earth and is to be captured by an orbiting satellite at its (the projectile's) apogee. So long as the velocities of the projectile 10 and the receiver 19 are non-relativistic, it will not matter which one is moving, the principles underlying the present disclosure are the same.

Additional aspects of the invention will be understood through reference to the following examples, which are provided by way of illustration and not limitation.

EXAMPLES

Bennett et al., "Electromagnetic Braking of a Metallic Projectile in Flight," *IEEE Transactions on Magnetics*, vol. MAG-21, p. 1250 (1985), incorporated herein by reference, provided correlations for determining the required stopping distance for a projectile of known momentum (mass times speed) or energy based on the strength of the magnetic field $B_0$ associated with the projectile 10 traveling through a conductive tube 20. In Bennett, the configuration was different from those disclosed herein where the field source 100 is carried on the projectile 10. In Bennett the projectile carries a passive metal sleeve but does not generate or have associated with it a magnetic field that moves with the projectile. Instead, the catch tube in Bennett carries a magnet that induces cooperating magnetic fields in the traveling projectile to exert a braking force. In Bennett the magnet must extend the entire length of the catch tube, presenting a significant initial and operating expense. Bennett's correlations were repeated for comparison, to determine whether the configurations disclosed here, where the projectile 10 carries a field source 100 and the catch tube (receiver 19) carries one or more closed unidirectional conductor(s) (30) had similar or better performance compared to Bennett. The disclosed constructions were considered economically advantageous.

It is believed that Bennett's correlations assume that both the trailing and leading magnetic fields described herein, $B_1$ and $B_2$ (which in Bennett would have been induced in the projectile itself, and in a resistive liner in the catch tube), will be induced in the conductive tube 20. Due to the above differences, Bennett's correlations may not be directly applicable to the embodiments disclosed here, where the leading magnetic field, $B_2$, is suppressed and a permanent magnetic field moves with the projectile 10. However, it was thought Bennett's correlations may provide a good first approximation for determining the required length of a receiver 19 as disclosed herein based on the strength of the magnetic field $B_0$ associated with the projectile 10. The inventors first repeated Bennett et al.'s calculations for the conditions therein disclosed, and then redid those calculations based on conditions relevant to an assumed hypervelocity projectile. This was to get an idea of the stopping-distance savings that may be achieved using a stronger electrical field produced by a superconducting field source 100, because it was contemplated that substantial braking force (field strength) would be required to assure a reasonably short stopping distance for a hypervelocity (high inertia) projectile. It was also contemplated that repeating Bennett's calculations may demonstrate the superiority of carrying the magnet (field source 100) on the projectile instead of on the catch tube as in Bennett.

Subsequently, the inventors performed measurements of brake performance with a projectile carrying a NdFeB magnet for speeds up to 20 m/s. These results were compared to calculations made using a recently published closed-form solution model for brake force (M. H. Partovi and E. J. Morris, "Electrodynamics of a magnet moving through a conducting pipe," *Canadian Journal of Physics*, vol. 84, pp. 253-271 (2006)). This model was then used to calculate stopping distances for magnets with a field achievable by superconducting materials, with receivers composed of titanium and aluminum, under conditions relevant to hypervelocity research. The inventors then performed tests with the brake tube replaced by a single winding with a diode in series, and repeated the test with the diode in the reverse orientation, while recording the motion of the projectile using a high-speed camera to determine the resulting projectile alignment within the receiver. These calculations and experiments are described in detail below.

A. Bennett Calculations

The force exerted on the projectile in the Bennett soft catch method can be estimated using Eq. (1) from Bennett et al.:

$$F=\frac{1}{m_p v}(\beta_l v^{1/2}-\beta_p t^{-1/2}), \tag{1}$$

where $m_p$ is the projectile mass, $\upsilon$ is its speed, and the first term in parenthesis is the heating rate in the liner, with $\beta_l$ given by Eq. (2):

$$\beta_l=\frac{2\pi r_1}{\sigma_l}\left(\frac{B_z'}{\mu_l}\right)\sqrt{\frac{2\mu_l\sigma_l L_p}{\pi}}, \tag{2}$$

In Eq. (2), $r_1$ is the inner radius of the liner, $\mu_l$ is the permeability of the liner, $\sigma_l$ is the conductivity of the liner, and $L_p$ is the projectile length. Similarly, $\beta_p$ in Eq. (1) is given by Eq. (3) below:

$$\beta_p = \frac{2\pi r_0}{\sigma_p}\left(\frac{B_z}{\mu_p}\right)L_p\sqrt{\frac{\mu_p\sigma_p}{2\pi}}, \tag{3}$$

In Eq. (3), similar terms are as defined above except that subscript $_0$ refers to the projectile, compared to subscript $_1$, which refers to the liner (tube). $B_z$ is the field in the space between the projectile and liner, given by Eq. (4):

$$B_z = B_0\left(\frac{r_1^2}{r_1^2 - r_0^2}\right). \tag{4}$$

In Eq. (4), $B_0$ is the magnetic field strength of the field emanating from (associated with) the projectile, analogous to the field $B_0$ described throughout this application. $B'_z$ is the increase in field in the region between the projectile and liner, given by Eq. (5):

$$B'_z = B_z - B_0. \tag{5}$$

In Bennett et al., a calculation was performed for a steel projectile and a copper liner, with the parameters $\iota_0$=600 m/s, $m_p$=6 kg, $L_p$=0.508 m, $r_0$=0.0508 m, $\mu_p=2\times10^{-4}$ Wb/A–m, $\sigma_p=0.38\times10^7$ mho/m, $r_1$=0.05334 m, $\mu_l=12.57\times10^{-7}$ Wb/A–m, $\sigma_l=5.8\times10^7$ mho/m, and $B_0$=1 Tesla. The result was a stopping distance of 12.9 m. We repeated the numerical solution of the equations of motion with the force given by Eq. (1), and calculated a stopping distance of 12.5 m based on the same parameters. The slight disagreement is most likely due to the use of different numerical methods.

We then repeated the calculation with parameters relevant to an assumed hypervelocity projectile moving at 2 km/s, namely: $\iota_0$=2000 m/s, $m_p$=1 kg, $L_p$=0.1 m, $r_0$=0.0254 m, and $r_1$=0.0255 m. For a 1 Tesla field, the stopping distance was calculated to be 118 m, while for 2 Tesla and 3 Tesla fields the stopping distances were calculated at 30 m and 13 m, respectively. These values will subsequently be compared to the method using a magnet carried by the projectile.

B. Permanent Magnet Tests

A coilgun was used to accelerate a projectile carrying a magnet into a receiver in the form of a catch tube. A series of windings along the launcher was used to measure the speed of the projectile before it reached the receiver, while a second set of windings at 10 cm intervals along the receiver was used to measure deceleration. The peak of the induced voltage at each winding was used to determine the projectile's position.

Figure 17A:
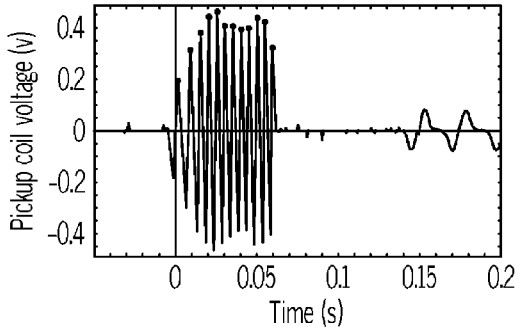
FIG. 17*a* graphs the voltage versus time of a pickup coil positioned in a glide section of a tube for receiving a projectile in an inductive-braking experiment described in the Examples, wherein a projectile carrying a permanent magnet is moving through the tube at an initial speed of 10 m/s. The voltage is correlated to the distance of the projectile from the coil.
Figure 17B:
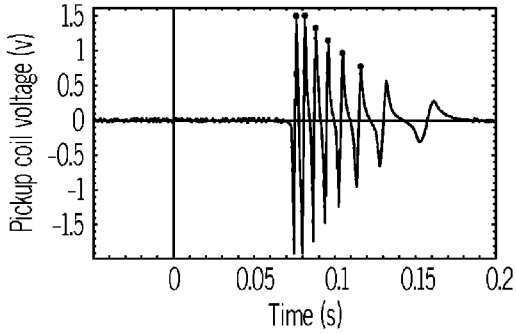
FIG. 17*b* is similar to FIG. 17*a*, except that it illustrates voltage versus time during a braking phase.
Figure 18A:
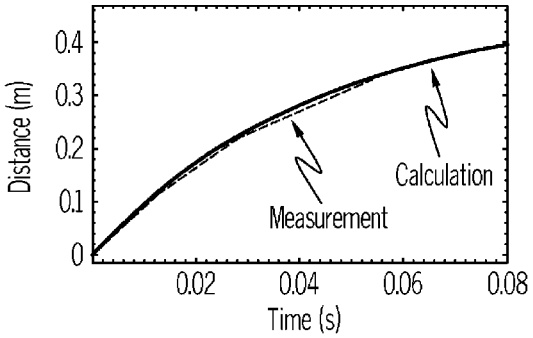
FIG. 18*a* compares calculated versus experimental position curves for a permanent magnet undergoing inductive braking as described in the Examples, for an initial speed of 10 m/s.

Using this experimental set-up, a projectile carrying a NdFeB permanent magnet was launched into a receiver at a speed of 10 m/s. The magnet had an outer diameter of 0.038 m, inner diameter of 0.019 cm, and length of 0.019 m. The projectile mass was 0.1 kg. The tube was composed of aluminum (6061-T6), with an outer diameter of 0.051 m, and an inner diameter of 0.048 m. The voltage induced in the pickup coils in a glide section is shown in FIG. 17*a*, and the induced voltage in the receiver is shown in FIG. 17*b*. From this, the position as a function of time was determined, which is shown in FIG. 18*a*. The results are compared to a prediction based on an expression for force as a function of velocity from Partovi and Morris (cited above), given by Eq. (6):

$$F = \mu_0\frac{m_d^2}{4\pi^2}\int_0^{1000} 2k^3\left(\frac{\sin\left[k\frac{L}{2}\right]}{k\frac{L}{2}}\right)^2\left(\frac{I_1[|k|a]}{|k|\frac{a}{2}}\right)^2 QI\,dk, \tag{6}$$

where $m_d$ is the dipole moment of the magnet, k is the angular wavenumber, $I_1$ is a modified Bessel function of the first kind, a is the radius of the magnet, L is length of the magnet, and QI is term containing several Bessel functions, not repeated here for brevity. The agreement between calculation and experiment is reasonable; the source of the disagreement is most likely friction between the projectile and tube, which was not included in the calculation.

Figure 18B:
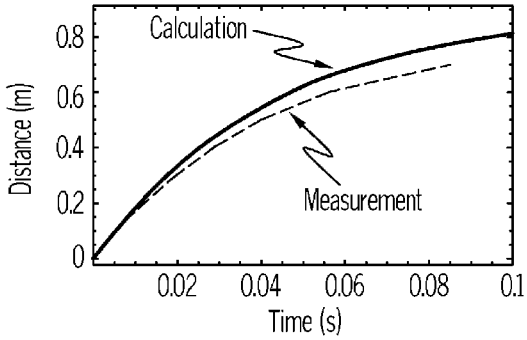
FIG. 18*b* compares calculated versus experimental position curves for a permanent magnet undergoing inductive braking as described in the Examples, for an initial speed of 20 m/s.

The test was repeated at a speed of 20 m/s. The position as a function of time is shown in FIG. 18*b*. Agreement between experiment and calculation is again close.

C. Calculations for Superconducting Magnet

Figure 19A:
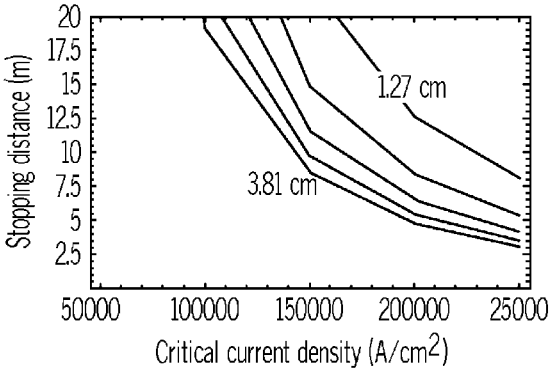
FIG. 19*a* is a graph of calculated stopping distance as a function of critical current carrying density for a field source in or associated with a projectile in an aluminum catch tube.
Figure 19B:
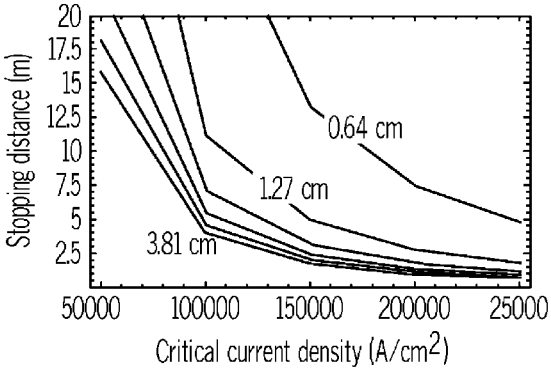
FIG. 19*b* is a graph of calculated stopping distance as a function of critical current carrying density for a field source in or associated with a projectile in a titanium catch tube.

The foregoing model (Eq. (6)) that was validated at low speeds for permanent magnets was then used to predict stopping distance for typical hypervelocity research conditions. Instead of a NdFeB magnet, parameters typical of magnets composed of a high-temperature YBCO superconductor were used. The outer diameter was assumed to be 0.0508 m, and the inner diameter was assumed to be 0.0254 m. Calculated stopping distance as a function of critical current density and length of a YBCO trapped field magnet are shown in FIG. 19*a* for an aluminum tube, and FIG. 19*b* for a titanium tube, both with an inner diameter of 0.066 m and an outer diameter of 0.086 m. The calculated stopping distance for the Ti tube was shorter due to the higher resistivity and thus higher power dissipation of Ti. The calculated stopping distance was shorter for longer magnets, as expected; a length of 2.54 cm is an approximate optimum considering the asymptotic behavior of stopping distance with increased magnet length and the additional mass of longer magnets. A critical current density, $J_C$, of 0.2 MA/cm$^2$ and 2.54 cm length, assuming $J_C$ does not depend on field, produces a field of 18 Tesla, which is at the limit of the state of the art for melt-textured YBCO. The calculated stopping distances were still practical for a $J_C$ of 0.1 MA/cm$^2$ and field of 9 Tesla, which is well within the demonstrated range of YBCO magnets.

Figure 20A:
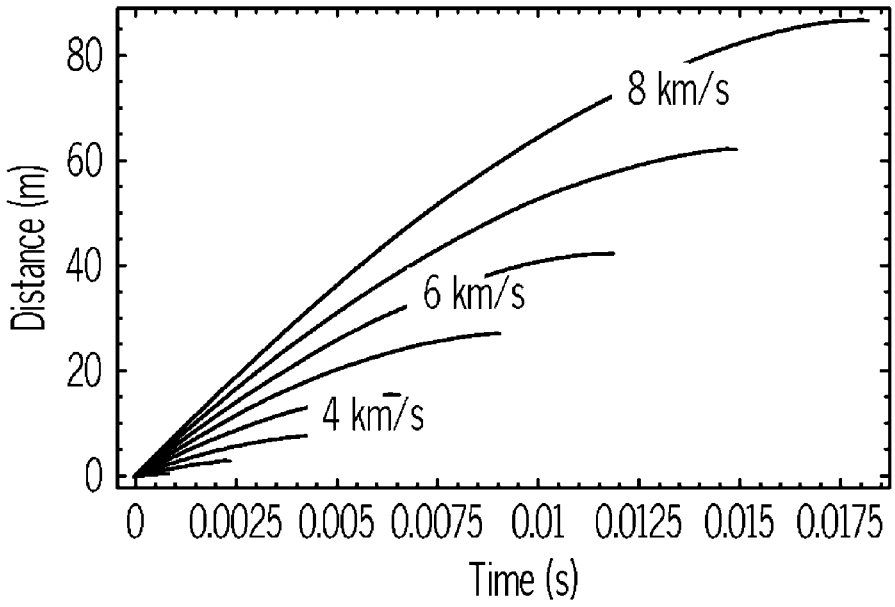
FIGS. 20*a*-*b* are graphs of calculated hypervelocity-projectile position versus time for initial speeds of 1 km/s through 8 km/s for a YBCO magnet as described in the Examples in an aluminum and a titanium catch tube, respectively.
Figure 20B:
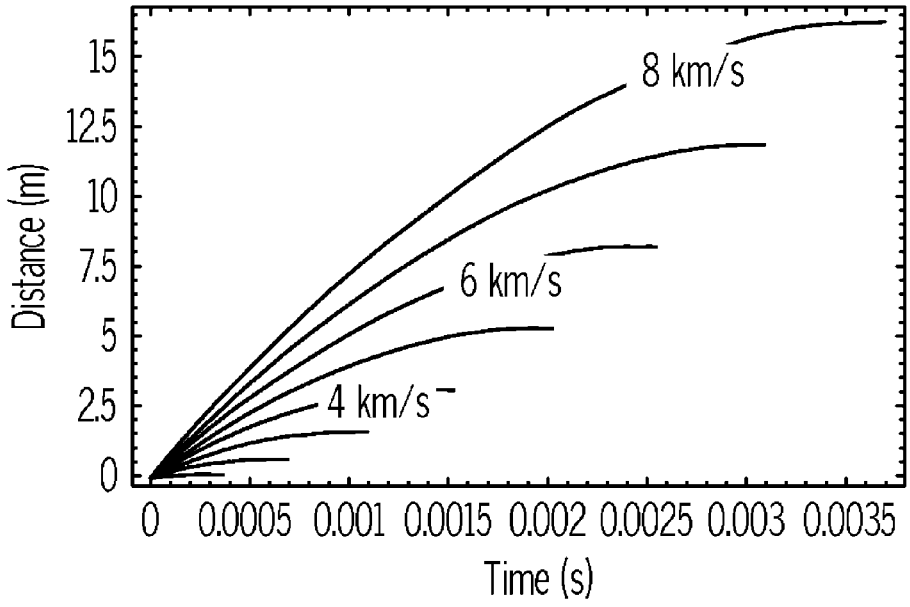
Figure 21A:
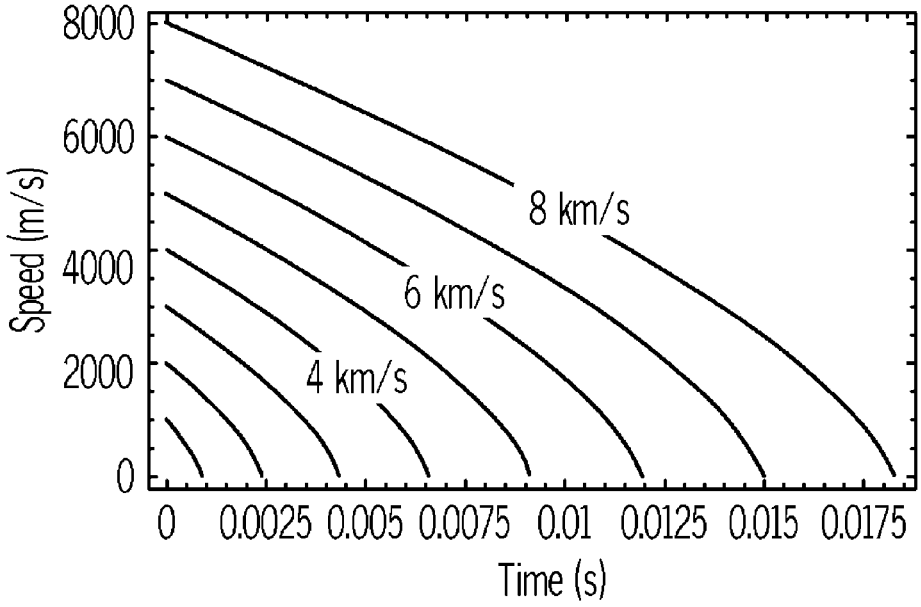
FIGS. 21*a*-*b* are graphs of calculated speed as a function of time across the same system as in FIG. 20 for the same YBCO magnet in the aluminum and the titanium catch tube, respectively.
Figure 21B:
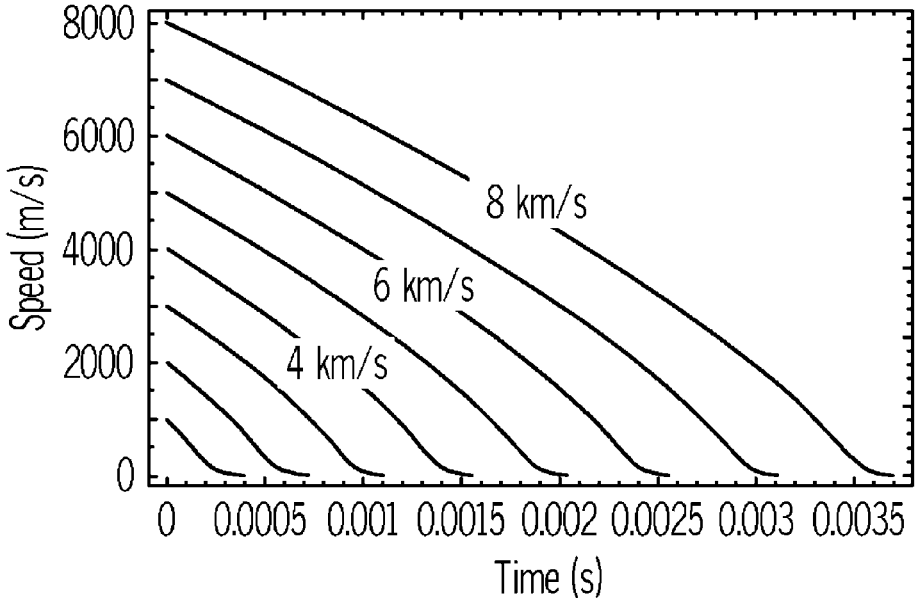
Figure 22A:
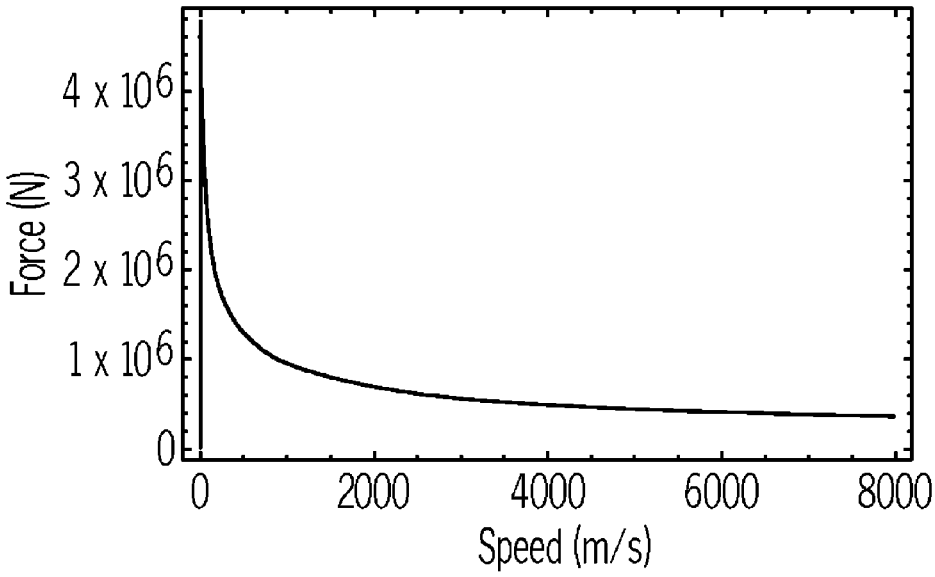
FIGS. 22*a*-*b* are graphs of calculated force as a function of speed for the same system as in FIGS. 20-21 for the same YBCO magnet in the aluminum and the titanium catch tube, respectively.
Figure 22B:
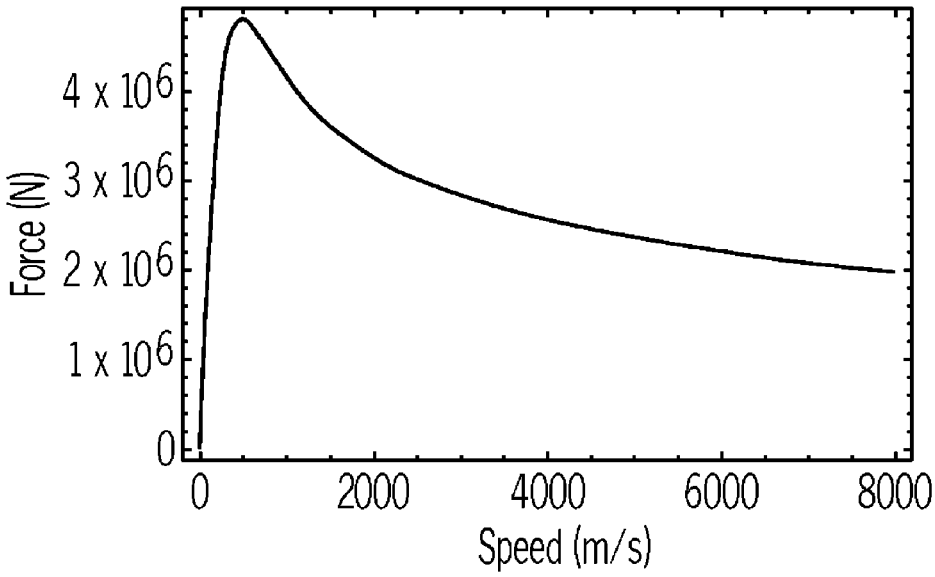

The performance of an inductive-braking system using this superconducting magnet (0.2 MA/cm$^2$) as the field source for the projectile 10 for initial speeds of 1 km/s through 8 km/s was calculated using the same model. Results for position as a function of time appear in FIGS. 20*a-b* for aluminum and titanium receivers, and for speed as a function of time in FIGS. 21*a-b* for aluminum and titanium receivers. The calculated stopping distance remained feasible for laboratory-scale study up to an initial speed of 8 km/s, which corresponds to a stopping distance of 16 m. Calculated stopping distances were uniformly shorter for tubes composed of Ti compared to Al. The behavior of the two materials is qualitatively different at low speeds. While the speed vs. time curves for the Al tube have a sharp cutoff, the curves for the Ti tube have tails that gradually approach zero speed. This is due to the differing conductivities of the materials. The force produced is plotted vs. speed in FIG. 22. The aluminum curve has a sharp peak at low speeds, while the Ti curve has a broader peak, and a broader region of linear increase near zero speed. In the very low speed regime, the force is larger for higher conductivity materials because an induced voltage of a given magnitude produces larger currents. However, the force for higher conductivity materials decreases more quickly with speed because of their stronger skin effect, which leads in effect to an increase in resistance with speed.

D. Centering Force

In order for capture of a hypervelocity projectile by a magnetic brake to be nondestructive, it is desirable that the projectile 10 not contact the walls of the receiver 19 as described previously. A centering force is also generated in the coaxial brake geometry based on the trailing magnetic field $B_1$ in the receiver 19 and its attraction to the magnetic field $B_0$ generated by the field source 100 of the projectile 10, as also explained above. If the field source 100 equivalent currents and tube 19 currents are approximated by filaments, the force between the filaments in general is given by the gradient of the mutual inductance between the filaments. The axial gradient can be expressed as by Eq. (7):

$$\frac{dM}{dz} = \frac{-\mu}{4}\sqrt{\frac{k}{r_1 r_2}}\,\frac{z}{1-k}((2-k)E[k]-2(1-k)K[k]), \tag{7}$$

where z is the axial separation, $r_1$ and $r_2$ are the filament radii, and E[k] and K[k] are Bessel functions of the first and second kind, given by Eqs. (8) and (9):

$$E[k] = \int_0^{\pi/2}\sqrt{1-k(\mathrm{Sin}[\phi])^2}\,d\phi, \tag{8}$$

$$K[k] = \int_0^{\pi/2}\frac{d\phi}{\sqrt{1-k(\mathrm{Sin}[\phi])^2}}, \tag{9}$$

and k is a geometric term given by Eq. (10):

$$k = \frac{4r_1 r_2}{(r_1+r_2)^2+z^2}, \tag{10}$$

Figure 23A:
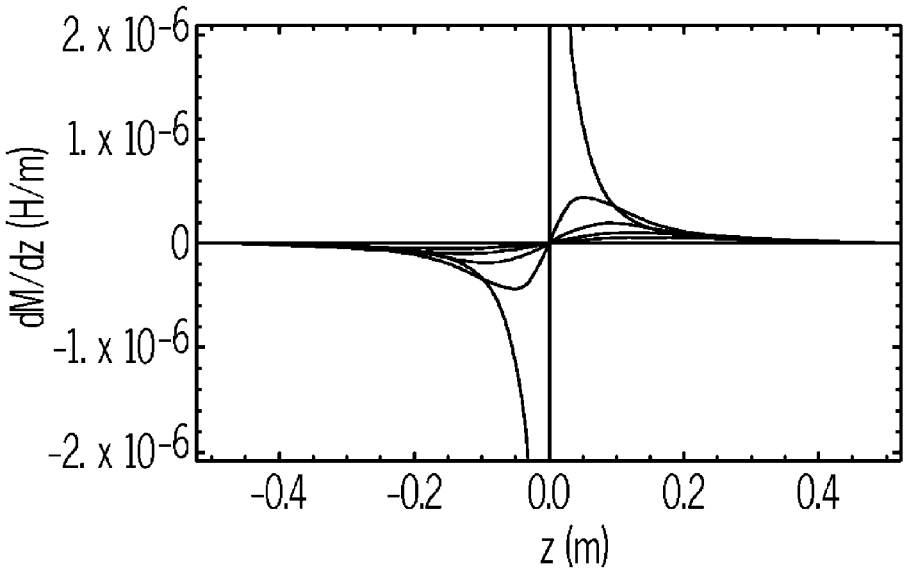
FIGS. 23*a*-*b* are graphs of calculated magnetic forces per unit current between a catch tube having an induced field and a projectile 10 having an associated magnetic field, using current filament approximation for various outer filament diameters as explained in the Examples.
Figure 23B:
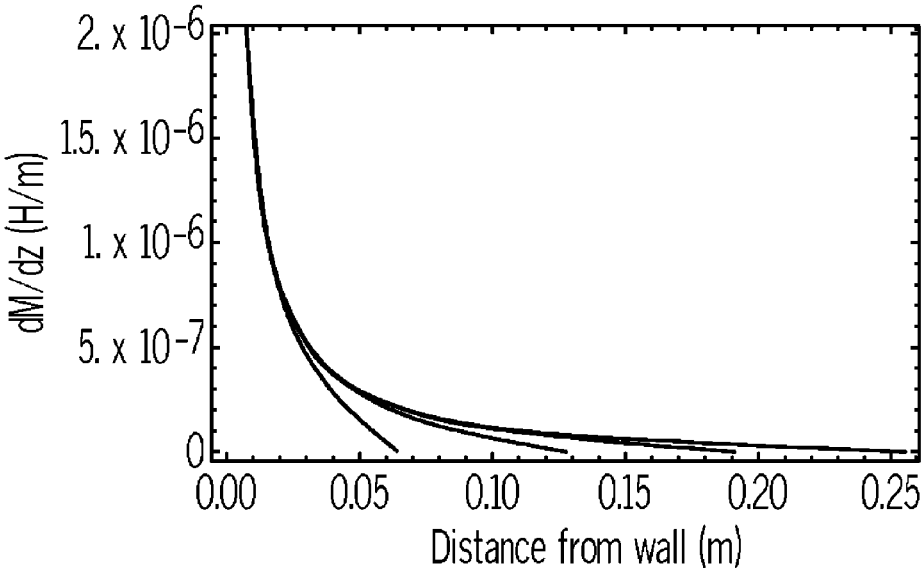

The calculated axial gradient as a function of axial separation is plotted for several tube diameters in FIG. 23*a*. An expression for the radial gradient was derived from Conway, "Inductance calculations for noncoaxial coils using Bessel functions," *IEEE Trans. Mag.*, vol. 43, pp. 1023-1034 (2007), and is plotted for the same tube diameters in FIG. 23*b* as a function of the radial position of the inner (projectile) filament. It can be seen that the axial and radial gradients are the same order of magnitude, which suggests that stable deceleration is possible. The curves for different wall diameters also tend to coincide for smaller gaps between the tube and projectile, and increase sharply as the projectile approaches the wall.

Figure 24A:
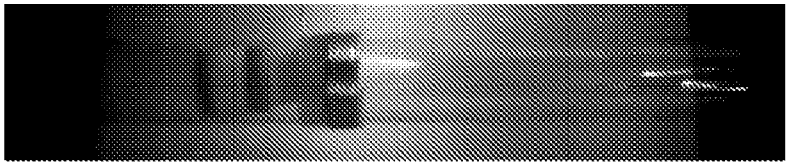
FIGS. 24*a*-*c* show a projectile having a permanent magnet traveling through a tube with a conductive coil wrapped therearound with the ends of the coil joined to form a closed circuit via a diode. In these figures, the diode is arranged so current is permitted to flow only in a direction that will generate a repulsive magnetic field on approach of the magnet attached to the projectile. Each of the figures shows the projectile at a successive time point during its travel through the tube and past the coil.
Figure 24B:
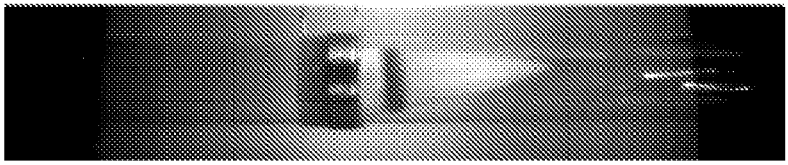
Figure 24C:
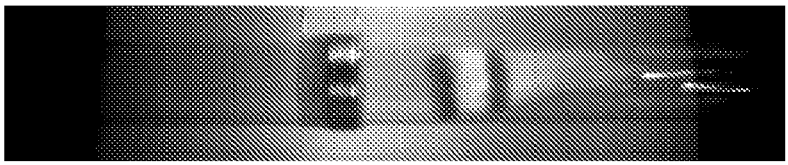

In order to confirm the capability attractive fields $B_1$ and $B_0$ to center and align the projectile 10 in the receiver 19, an experiment was performed using a projectile carrying a NdFeB magnet. The projectile was fired at a speed of 28 m/s into a polycarbonate tube that had an inner radius large enough to allow the projectile's long axis to rotate slightly. The projectile was fired using the same coilgun described above. In order to observe the alignment of the projectile within the diode-limited receiver winding, the projectile's motion was recorded using a high speed camera (Redlake MotionScope M2). FIGS. 24*a-c* show successive equally time-spaced images taken using a high speed camera, operating at 2000 frames per second, of a test shot in which the diode in series with the coil was orientated so that currents flowed as the projectile approached the coil in direction that generated a field that repelled the projectile, analogous to field $B_2$ described throughout this application. From the images, it can be clearly seen that when the induced field in the receiver repels the field associated with the moving projectile, the projectile is deflected radially toward the catch-tube wall, visibly skewing its flight.

Figure 25A:
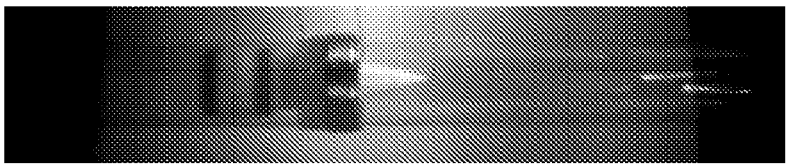
FIG. 25*a*-*c* show the same system as in FIGS. 24*a*-*c*, but this time with the diode arranged so that current is permitted to flow only in a direction that will generate an attractive magnetic field as the magnet attached to the projectile passes the coil.
Figure 25B:
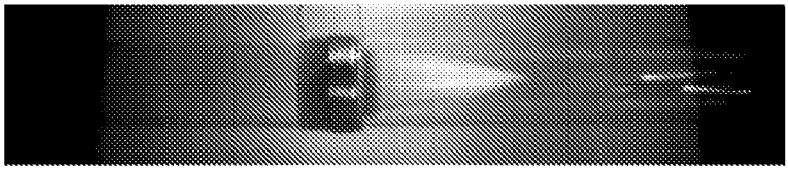
Figure 25C:
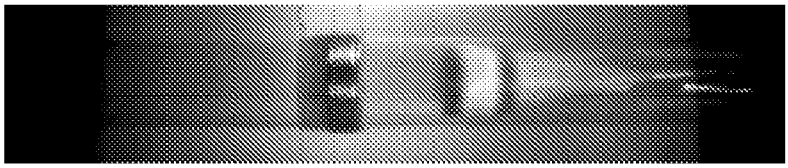

Next, the orientation of the diode was reversed so that the induced magnetic field in the receiver now attracted the magnetic field of the projectile. The projectile was again fired as before, and high-speed images were taken. These images are shown in FIGS. 25*a-c*, which are analogous to FIGS. 24*a-c* bith the diode in the reverse sense. From FIGS. 25*a-c*, it can be seen that suppressing the current as the projectile approaches, but causing the projectile to be attracted after it passes the midpoint of the coil resulted in centering and aligning the projectile with the tube. The test shots were repeated for each diode orientation, and exhibited consistent behavior.

E. Conclusion

For a projectile with a mass of 1 kg traveling with an initial speed of 2 km/s, a soft catch method proposed by Bennett et al. is predicted to stop the projectile in 13 m when the applied field is 3 Tesla. The same projectile can be stopped in approximately the same distance if a field source 100 made of existing superconducting materials is carried by the projectile. The Bennett method requires a field to be applied over the entire length of deceleration, in this case 13 m, which represents a significant initial and operating cost, whether the magnet technology is conventional or superconducting. Conversely, for the method based on a projectile-mounted magnet, the receiver uses only passive components, resulting in a nondestructive hypervelocity brake with minimal initial and operating costs.

Although the hereinabove described embodiments of the invention constitute the preferred embodiments, it should be understood that modifications can be made thereto without departing from the scope of the invention as set forth in the appended claims.

What is claimed is:

1. An inductive-braking system, comprising a projectile having an associated magnetic field that moves with the projectile, a unidirectional conductor comprising a first winding of a strip of conductive material wound around a longitudinal axis, said first winding having a first inner terminus and first outer terminus, said first inner and outer termini being connected via at least one diode to complete a closed conductive pathway that permits current to flow in substantially only one direction through said pathway, and a passageway for receiving said projectile, said passageway passing through a center of said first winding such that said first winding encircles said passageway.

2. The system of claim 1, said unidirectional conductor further comprising a second winding of a strip of conductive material, said first and second windings being concentric and axially adjacent one another such that said passageway passes through a center of both windings, said windings being electrically connected together to complete said closed conductive pathway.

3. The system of claim 2, said second winding having a second inner terminus and a second outer terminus, said outer termini being radially more distant from said longitudinal axis than said inner termini, wherein adjacent termini of the respective windings are connected together.

4. The system of claim 2, each said first and second windings having a plurality of turnings wound radially over one another such that current traveling through said conductive pathway travels through a radial depth of said windings and is not substantially confined at or adjacent an inner surface proximate said passageway.

5. The system of claim 3, said first and second outer termini being connected together via at least one diode.

6. The system of claim 3, each of the adjacent inner and outer termini of said first and second windings being connected together via at least one diode.

7. The system of claim 1, said first outer terminus being radially more distant from said longitudinal axis than said first inner terminus.

8. The system of claim 1, said first winding of conductive material having a plurality of successive turnings wound at successive radial depths of said first winding, such that current traveling through said first winding travels through said depths thereof and is not substantially confined at or adjacent an inner surface thereof proximate said passageway.

9. The system of claim 1, comprising a plurality of said unidirectional conductors disposed at axially-spaced intervals along a length of said passageway.

10. The system of claim 1, said projectile comprising a superconducting magnet for generating said magnetic field, said magnetic field having a field strength of at least 2 Tesla.

11. The system of claim 1, said projectile comprising a YBCO superconducting magnet for generating said magnetic field.

12. The system of claim 1, said unidirectional conductor being passive such that any current therein is induced by an applied magnetic field.

13. The system of claim 1, the magnetic field associated with said projectile inducing a current in said unidirectional conductor, said current flowing through said unidirectional conductor substantially in said only one direction.

14. An inductive-braking system, comprising a unidirectional conductor having a closed conductive pathway that permits current to flow in substantially only one direction, and a passageway for receiving a projectile, said passageway having a longitudinal axis, said unidirectional conductor being arranged such that said closed conductive pathway encircles said longitudinal axis, said unidirectional conductor comprising a cylinder of conductive material that is discontinuous along a longitudinal slit extending the length of said cylinder, wherein opposing longitudinal edges of the cylinder wall on opposite sides of said slit are connected via at least one diode.

15. The system of claim 14, comprising a plurality of diodes connecting said opposing longitudinal edges at spaced intervals along said length.

16. A method of decelerating a projectile, comprising:

a) generating a first magnetic field that moves with said projectile;

b) directing said projectile along a path that is encircled by a closed conductive pathway; and c) inhibiting induction of a current through said conductive pathway in a direction that would generate a magnetic field of opposite polarity to said first magnetic field;

wherein as said projectile travels past said closed conductive pathway along said path, said first magnetic field produces a changing magnetic flux in a vicinity of said closed conductive pathway that induces a current in said closed conductive pathway in a direction that produces a second magnetic field having the same polarity as said first magnetic field.

17. The method of claim 16, said closed conductive pathway being provided by a winding of conductive material having a plurality of successive turnings wound at successive radial depths of said unidirectional conductor, such that current traveling through said unidirectional conductor travels through said depths thereof and is not substantially confined at or adjacent an inner surface thereof proximate the path of said projectile.

18. The method of claim 16, said closed conductive pathway comprising at least one diode, said diode permitting current to flow in substantially only the direction that generates said second magnetic field having the same polarity as the first magnetic field.

19. The method of claim 16, wherein said first and second magnetic fields attract one another to both exert a braking force on said projectile and center said projectile along a common central axis of said first and second magnetic fields.

20. The method of claim 16, said projectile comprising a superconducting field source for generating said first magnetic field, said first magnetic field having a field strength of at least 2 Tesla.

21. The method of claim 16, said projectile traveling at a speed of at least 2 kilometers per second on approaching said closed conductive pathway.

22. The method of claim 16, wherein the projectile is stationary and said closed conductive pathway is moving.

23. An inductive-braking system comprising:

a receiver comprising a passageway for receiving a projectile, and a unidirectional conductor having a closed conductive pathway that encircles said passageway and permits current to flow in substantially only one direction around said passageway; and a projectile traveling through said passageway, wherein a first magnetic field moves with said projectile;

said first magnetic field producing a changing magnetic flux in a vicinity of said closed conductive pathway, which induces a current to flow through said closed conductive pathway in said one direction around said passageway, said current generating a second magnetic field at a location behind said projectile, said second magnetic field having the same polarity as said first magnetic field such that an attraction between them exerts a braking force on said projectile and also tends to align said first magnetic field, which is moving with said projectile, on a common central axis with said second magnetic field.

24. The system of claim 23, said projectile comprising a field source that generates said first magnetic field.

25. The system of claim 24, said field source comprising a persistent-current superconducting magnet.

26. The system of claim 24, said persistent-current superconducting magnet comprising a high-temperature superconductor.

27. The system of claim 25, said persistent-current superconducting magnet being disposed within a cooling jacket filled with a liquid cryogen.

28. The system of claim 23, said passageway being defined by a wall, the alignment of said first and second magnetic fields centering said projectile within said passageway so as not to be in contact with said cylindrical wall.

29. The system of claim 28, said wall being cylindrical.

30. The system of claim 23, said receiver comprising a plurality of said unidirectional conductors encircling said passageway at spaced axial intervals along a length of said passageway.

31. The system of claim 23, said unidirectional conductor comprising first and second windings of strips of conductive material, said windings being concentric and axially adjacent such that said passageway passes through a center of both windings, said windings being electrically connected together via at least one diode to complete said closed conductive pathway.

32. The system of claim 23, said unidirectional conductor comprising a winding of conductive material having a plurality of successive turnings wound at successive radial depths of said unidirectional conductor, such that current traveling through said unidirectional conductor travels through said depths thereof and is not substantially confined at or adjacent an inner surface thereof proximate said passageway.

* * * * *

UNITED STATES PATENT AND TRADEMARK OFFICE

CERTIFICATE OF CORRECTION

PATENT NO. : 8,237,526 B2
APPLICATION NO. : 12/481147
DATED : August 7, 2012
INVENTOR(S) : Philip Travis Putman and Kamel Salama It is certified that error appears in the above-identified patent and that said Letters Patent is hereby corrected as shown below:

At Column 19, Line 26, replace "$l_0$=600 m/s" with "$v_0$=600 m/s".

At Column 19, Line 39, replace "$l_0$=2000 m/s" with "$v_0$=2000 m/s".

Signed and Sealed this
Twenty-third Day of October, 2012

David J. Kappos

David J. Kappos
*Director of the United States Patent and Trademark Office*